US008371894B1

(12) United States Patent
Rosen et al.

(10) Patent No.: US 8,371,894 B1
(45) Date of Patent: Feb. 12, 2013

(54) ILLUMINATED TOY CONSTRUCTION KIT

(75) Inventors: Lawrence Rosen, Mendham, NJ (US); Parviz Daftari, Summit, NJ (US)

(73) Assignee: LaRose Industries, LLC, Randolph, NJ (US)

( * ) Notice: Subject to any disclaimer, the term of this patent is extended or adjusted under 35 U.S.C. 154(b) by 0 days.

(21) Appl. No.: 13/365,907

(22) Filed: Feb. 3, 2012

Related U.S. Application Data

(60) Provisional application No. 61/579,769, filed on Dec. 23, 2011.

(51) Int. Cl.
*A63H 33/04* (2006.01)
*A63H 33/26* (2006.01)

(52) U.S. Cl. ..... 446/91; 446/102; 446/485

(58) Field of Classification Search ..... 446/85, 446/91, 111, 112, 122, 124, 125, 236, 484, 446/485, 102, 104; 362/104
See application file for complete search history.

(56) References Cited

U.S. PATENT DOCUMENTS

| | | | |
|---|---|---|---|
| 2,416,959 | A | 3/1947 | Herzel |
| 2,923,550 | A | 2/1960 | Blackman et al. |
| 2,967,267 | A | 3/1961 | Steinman et al. |
| 2,983,071 | A | 5/1961 | Stewart |
| 3,195,266 | A | 7/1965 | Onanian |
| 3,237,341 | A | 3/1966 | Janning |
| 3,447,249 | A | 6/1969 | Greger |
| 3,484,984 | A | 12/1969 | Fischer |
| 3,513,589 | A | 5/1970 | Fischer |
| 3,553,883 | A | 1/1971 | Fischer |
| 3,576,936 | A | 5/1971 | Fischer |
| 3,589,056 | A | 6/1971 | Glass et al. |
| 3,605,323 | A | 9/1971 | Fischer |
| 3,634,678 | A | 1/1972 | Glass et al. |
| 3,645,035 | A | 2/1972 | Fischer |
| 3,696,548 | A | 10/1972 | Teller |
| 3,804,411 | A | 4/1974 | Hendry |
| 3,970,350 | A | 7/1976 | Takahaski |
| 4,002,893 | A | 1/1977 | Newcomb et al. |
| 4,010,555 | A | 3/1977 | Paulsson |
| 4,050,184 | A | 9/1977 | Chiari |

(Continued)

FOREIGN PATENT DOCUMENTS

| | | |
|---|---|---|
| DE | 613379 | 5/1935 |
| DE | 1547502 A1 | 11/1969 |

(Continued)

OTHER PUBLICATIONS

Photos of six views of Product Packaging for Laser Pegs® Lighted Construction Kit, © 2011.

(Continued)

*Primary Examiner* — Gene Kim
*Assistant Examiner* — Alyssa Hylinski
(74) *Attorney, Agent, or Firm* — Greenberg Traurig, LLP

(57) ABSTRACT

An illuminated toy construction kit includes a plurality of illumination modules having various shapes and sizes, and a plurality of non-illumination modules having different shapes and sizes. Each of the illumination modules includes at least one light-emitting element, such as, for example, a color-varying LED. At least some of the non-illumination modules are in the form of couplers which function as mechanical linkages for interconnecting the illumination modules and enabling a user to form a variety of three-dimensional structural shapes. The couplers also function to transmit electric power between the interconnected illumination modules, whereby all of the interconnected modules may be simultaneously illuminated in response to the activation of a single power source connected to at least one of the illumination modules.

20 Claims, 22 Drawing Sheets

U.S. PATENT DOCUMENTS

| | | | | |
|---|---|---|---|---|
| 4,109,398 | A | 8/1978 | Hida | |
| 4,121,374 | A | 10/1978 | Fischer | |
| 4,171,591 | A | 10/1979 | Fischer | |
| 4,199,894 | A | 4/1980 | Fischer | |
| 4,246,718 | A | 1/1981 | Chatani | |
| 4,305,221 | A | 12/1981 | Chatani | |
| 4,306,373 | A | 12/1981 | Chatani et al. | |
| 4,423,465 | A | 12/1983 | Teng-Ching et al. | |
| 4,461,480 | A * | 7/1984 | Mitchell | 273/153 S |
| 4,484,407 | A | 11/1984 | Petersson | |
| 4,509,929 | A | 4/1985 | Zawitz | |
| 4,532,579 | A * | 7/1985 | Merryman | 362/239 |
| 4,552,541 | A | 11/1985 | Bolli | |
| 4,556,393 | A | 12/1985 | Bolli | |
| 4,619,625 | A | 10/1986 | Seki et al. | |
| 4,629,192 | A | 12/1986 | Nichols | |
| 4,667,277 | A | 5/1987 | Hanchar | |
| 4,696,647 | A | 9/1987 | Ahmad | |
| 4,743,202 | A | 5/1988 | Bach | |
| 4,754,380 | A * | 6/1988 | Wang | 362/244 |
| 4,820,171 | A | 4/1989 | Korteqaard | |
| 4,869,701 | A | 9/1989 | Kawai et al. | |
| 4,883,440 | A | 11/1989 | Bolli | |
| 4,895,544 | A | 1/1990 | Fischer | |
| 4,915,666 | A | 4/1990 | Maleyko | |
| 4,978,306 | A * | 12/1990 | Robb | 439/8 |
| 4,989,881 | A | 2/1991 | Gamble | |
| 4,998,903 | A | 3/1991 | Bolli et al. | |
| 5,018,980 | A * | 5/1991 | Robb | 439/8 |
| 5,054,778 | A | 10/1991 | Maleyko | |
| 5,241,875 | A | 9/1993 | Kochanneck | |
| 5,458,522 | A | 10/1995 | Brooks, III | |
| 5,545,070 | A | 8/1996 | Liu | |
| 5,751,117 | A | 5/1998 | Abbott | |
| 5,826,872 | A | 10/1998 | Hall | |
| 5,833,465 | A | 11/1998 | Jarzewiak | |
| 5,848,503 | A | 12/1998 | Toft et al. | |
| 5,853,314 | A | 12/1998 | Bora | |
| 5,902,166 | A | 5/1999 | Robb | |
| 5,924,906 | A | 7/1999 | Grafton | |
| 6,050,044 | A | 4/2000 | McIntosh | |
| 6,062,937 | A | 5/2000 | Kikuchi | |
| 6,082,876 | A | 7/2000 | Hanson et al. | |
| 6,086,444 | A | 7/2000 | Glickman | |
| 6,135,606 | A | 10/2000 | Fernandez et al. | |
| 6,238,261 | B1 | 5/2001 | Lang | |
| 6,428,432 | B1 | 8/2002 | Kachel | |
| 6,443,796 | B1 | 9/2002 | Shackelford | |
| 6,482,136 | B1 | 11/2002 | Kessler | |
| 6,491,563 | B1 | 12/2002 | Bailey | |
| 6,524,159 | B1 * | 2/2003 | Kawarizadeh | 446/397 |
| 6,561,866 | B1 | 5/2003 | Lee | |
| 6,585,553 | B1 | 7/2003 | Fetridge et al. | |
| 6,626,727 | B2 | 9/2003 | Balanchi | |
| 6,679,751 | B1 | 1/2004 | Maxwell et al. | |
| 6,805,605 | B2 | 10/2004 | Reining et al. | |
| 6,846,216 | B1 | 1/2005 | Balanchi | |
| 7,063,587 | B1 | 6/2006 | Lin | |
| 7,080,927 | B2 * | 7/2006 | Feuerborn et al. | 362/368 |
| 7,255,624 | B2 | 8/2007 | Daftari | |
| 7,322,873 | B2 | 1/2008 | Rosen et al. | |
| D580,995 | S | 11/2008 | Chun | |
| 7,507,136 | B2 | 3/2009 | Patton | |
| 7,731,558 | B2 | 6/2010 | Capriola | |
| 7,846,002 | B1 | 12/2010 | Mikesell et al. | |
| 2002/0115373 | A1 | 8/2002 | Lazerman | |
| 2003/0040250 | A1 | 2/2003 | Yim et al. | |
| 2003/0148700 | A1 | 8/2003 | Arlinsky et al. | |
| 2004/0018473 | A1 | 1/2004 | Tusacciu | |
| 2004/0063380 | A1 | 4/2004 | Chi et al. | |
| 2004/0185745 | A1 | 9/2004 | Reining et al. | |
| 2005/0024855 | A1 | 2/2005 | Ruiz et al. | |
| 2006/0084357 | A1 | 4/2006 | Rosen et al. | |
| 2006/0134978 | A1 | 6/2006 | Rosen et al. | |
| 2007/0010164 | A1 | 1/2007 | Kowalski | |
| 2007/0200289 | A1 | 8/2007 | Morikawa et al. | |
| 2008/0139040 | A1 * | 6/2008 | Hsu et al. | 439/419 |
| 2008/0139077 | A1 | 6/2008 | Patton | |
| 2008/0160875 | A1 | 7/2008 | Leicht | |
| 2008/0198599 | A1 | 8/2008 | Lai | |
| 2009/0047863 | A1 * | 2/2009 | Capriola | 446/91 |
| 2011/0143629 | A1 | 6/2011 | Seymour et al. | |
| 2011/0151743 | A1 | 6/2011 | Munch et al. | |
| 2011/0217898 | A1 | 9/2011 | Barber | |

FOREIGN PATENT DOCUMENTS

| | | | |
|---|---|---|---|
| DE | 1959943 | | 11/1969 |
| DE | 3146247 | A1 | 11/1981 |
| EP | 0 125 335 | | 11/1984 |
| GB | 1139315 | A | 1/1969 |
| GB | 2 188 956 | A | 10/1987 |
| KR | 90001823 | | 3/1990 |
| KR | 20050035986 | | 4/2005 |
| WO | WO 90/09824 | | 9/1990 |
| WO | WO 2009/023037 | | 2/2009 |

OTHER PUBLICATIONS

Instruction Manual for Laser Pegs® Lighted Construction Kits, © 2011.

Product Information Sheet for Laser Pegs®, © 2011.

Product packaging for Laser Pegs® AC Power Accessory Pack, © 2010.

Marketing card for Laser Pegs® Lighted Construction Kits, © 2011.

Cover sheet for Sharper Image Holiday 2011 Catalog and p. 9 of same.

The Sharper Image Website, www.sharperimage.com/si/view/product/Laser-Pegs-Lighted-Construction-Set/200431, depicting images of Laser Pegs® Lighted Construction Set, retrieved Nov. 29, 2011.

Laser Pegs 2012 Catalog.

Photos of two views of Product Packaging for Stackables Construction Compatibility Kit, © 2012.

English translation of German Patent No. DE 613379 (7 pages).

English translation of Korean Patent No. KR 20050035986 (7 pages).

English translation of Korean Patent No. KR 1990001823 (6 pages).

* cited by examiner

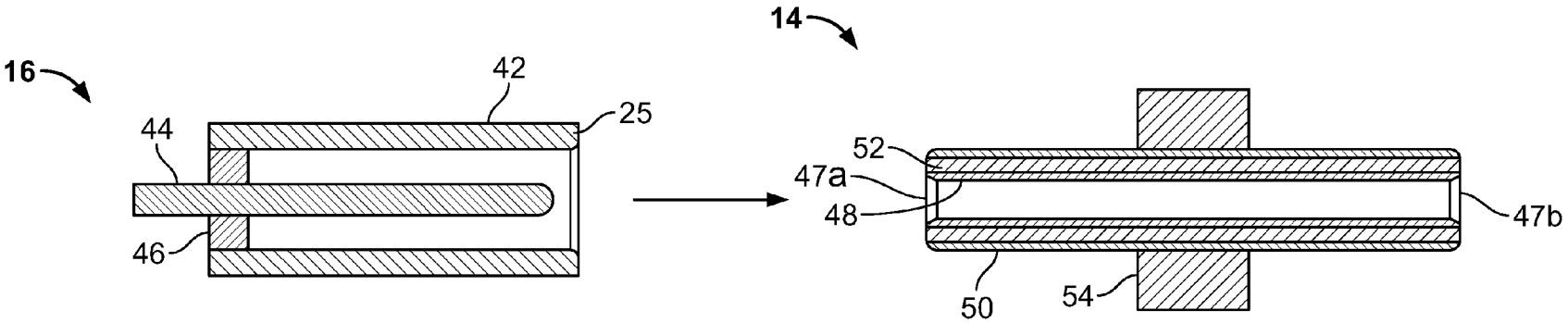
FIG. 2C
FIG. 2B
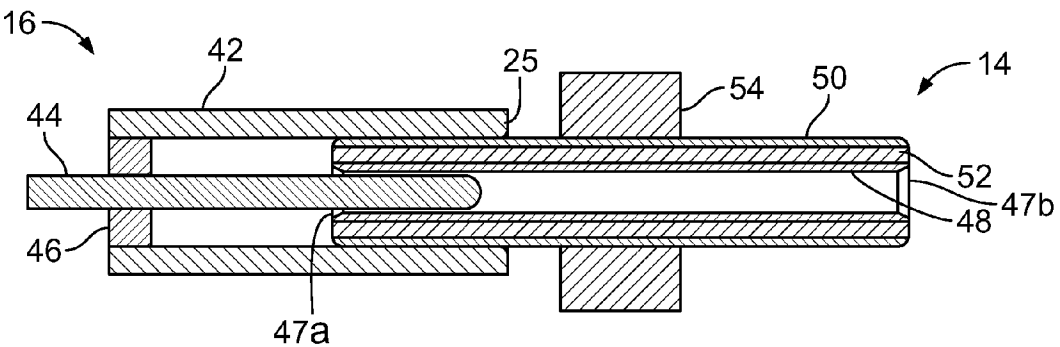
FIG. 2D

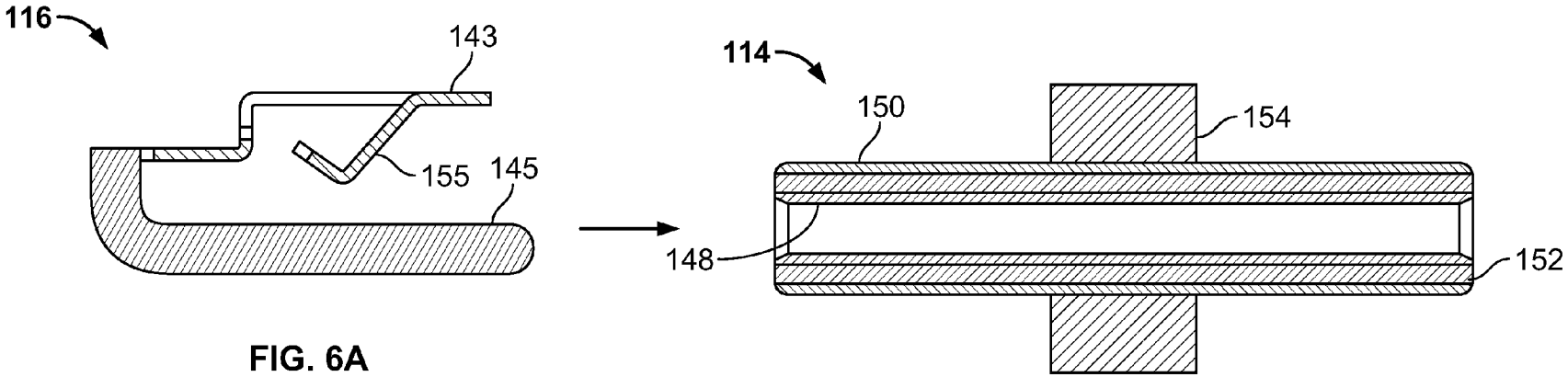
FIG. 6B
FIG. 6A
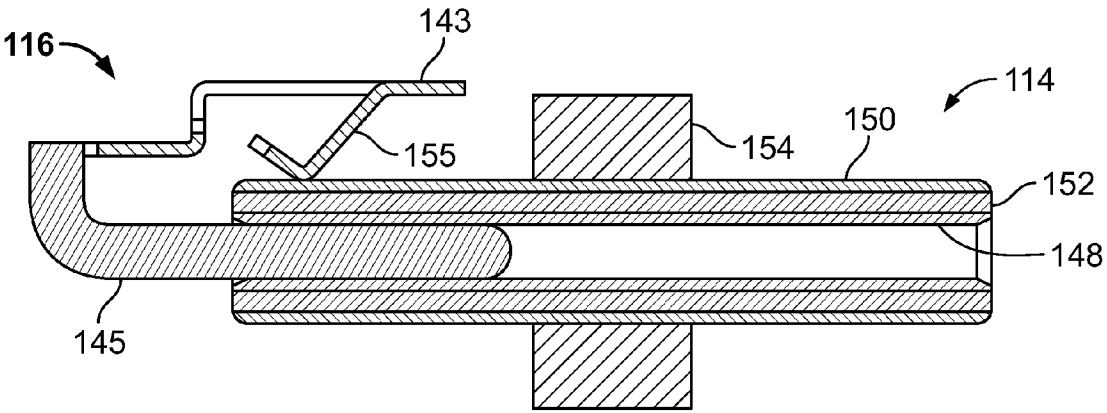
FIG. 6C

114

Shape H

114

Shape I

114

Shape J

ILLUMINATED TOY CONSTRUCTION KIT

RELATED APPLICATION

This application claims the benefit of U.S. Provisional Patent Application Ser. No. 61/579,769, filed Dec. 23, 2011, the disclosure of which is incorporated by reference herein in its entirety.

FIELD OF THE INVENTION

The present invention relates a toy, and, more particularly, to a toy construction kit for building three-dimensional structures utilizing various construction components, some of which have illuminated elements.

BACKGROUND OF THE INVENTION

Illuminated toy construction kits frequently include a plurality of illuminating modules. Individuals often find enjoyment in interconnecting the illuminating modules to form different assembled structural shapes. The illuminating modules are typically activated by electrical power, thereby providing luminescence to the assembled structural shapes. Such luminescence can be an aesthetically appealing characteristic of the structural shapes.

SUMMARY OF THE INVENTION

The present invention relates to an illuminated toy construction kit including a plurality of illumination modules having various shapes and sizes, and a plurality of non-illumination modules having different shapes and sizes. At least some of the non-illumination modules are in the form of couplers that function as connecting means or mechanisms for interconnecting the illumination modules and enabling a user to form a variety of three-dimensional structural shapes.

Each of the illumination modules includes at least one light-emitting element, such as, for example, a color-varying LED, and at least one jack having a female-like socket at one end, which releasably receives a male-like (i.e., plug) end of one of the couplers, and whose other end is electrically connected to the light-emitting element via electric circuitry or the like.

Unlike the illumination modules, the couplers are not provided with any light-emitting elements whatsoever. However, the couplers do function to permit a plurality of illumination modules to be mechanically connected in a ganged or daisy-chained manner. The couplers also function to transmit electric power between the interconnected illumination modules, whereby all of the interconnected modules may be simultaneously illuminated in response to the activation of a single power source connected to at least one of the illumination modules.

BRIEF DESCRIPTION OF THE DRAWINGS

For a more complete understanding of the present invention, reference is made to the following detailed description of various exemplary embodiments considered in conjunction with the accompanying drawings, in which:

FIG. 2B is a cross-sectional view, taken along section line 2B-2B and looking in the direction of the arrows, of a jack employed by the illumination module shown in FIG. 2A;

FIG. 2C is a cross-sectional view, taken along section line 2C-2C and looking in the direction of the arrows, of the coupler shown in FIG. 2A;

FIG. 2D is a composite of FIGS. 2B and 2C, the resulting cross-sectional view depicting the interconnection between the jack shown in FIG. 2B and the coupler shown in FIG. 2C;

FIG. 6A is a cross-sectional view, taken along section line 6A-6A and looking in the direction of the arrows, of a jack employed by the printed circuit board assembly shown in FIG. 5B, the jack being shown in an upside-down orientation;

FIG. 6B is a cross-sectional view, taken along section line 6B-6B and looking in the direction of the arrows, of the coupler shown in FIG. 4;

FIG. 6C is a composite of FIGS. 6A and 6B, the resulting cross-sectional view depicting the interconnection between the jack shown in FIG. 6A and the coupler shown in FIG. 6B;

DETAILED DESCRIPTION OF THE EXEMPLARY EMBODIMENTS

Figure 1:
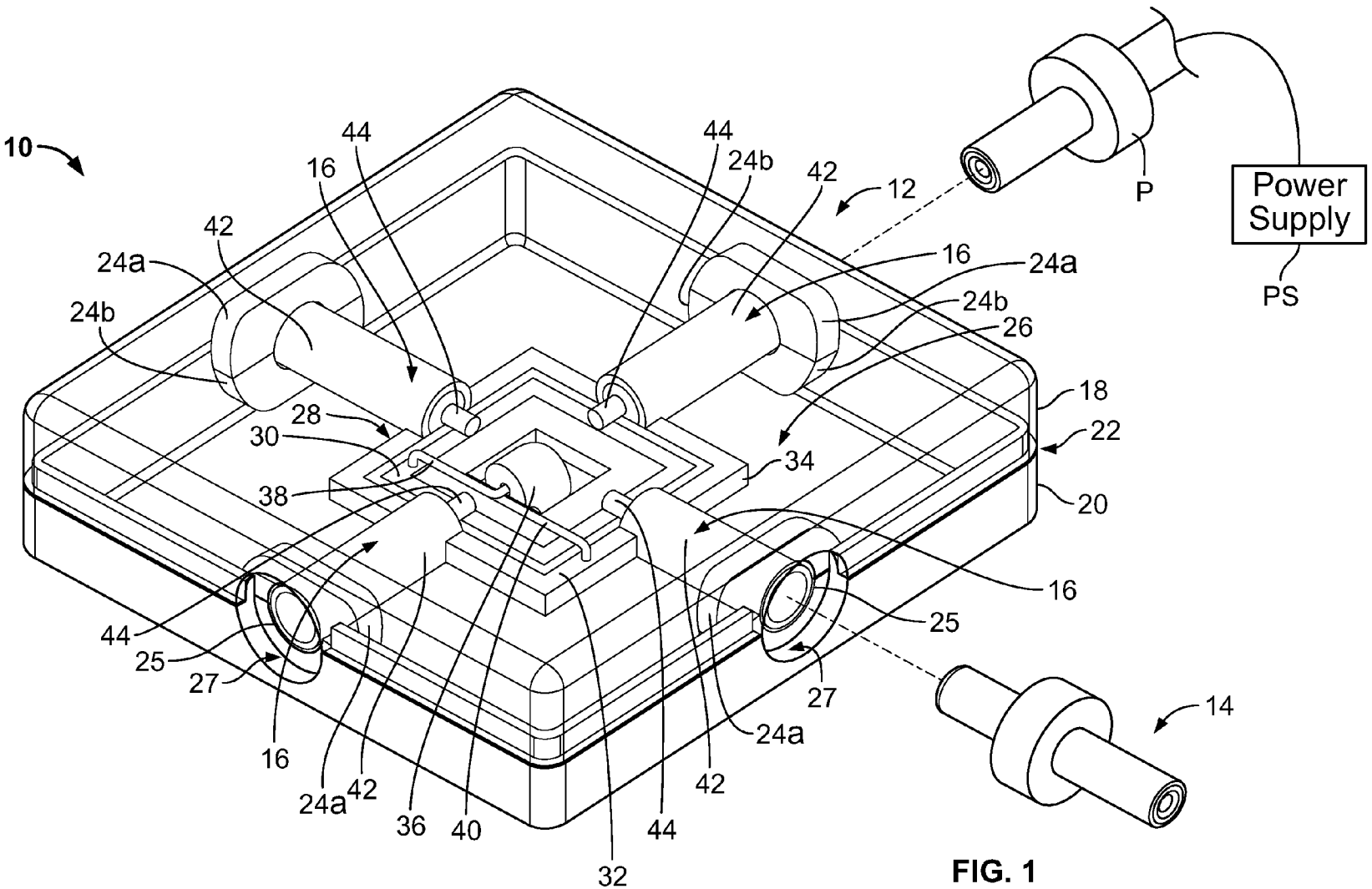
FIG. 1 is an exploded, top perspective view of an illumination module and coupler constructed in accordance with an embodiment of the present invention, the module and coupler being shown in combination with a schematically illustrated power source.
Figure 2A:
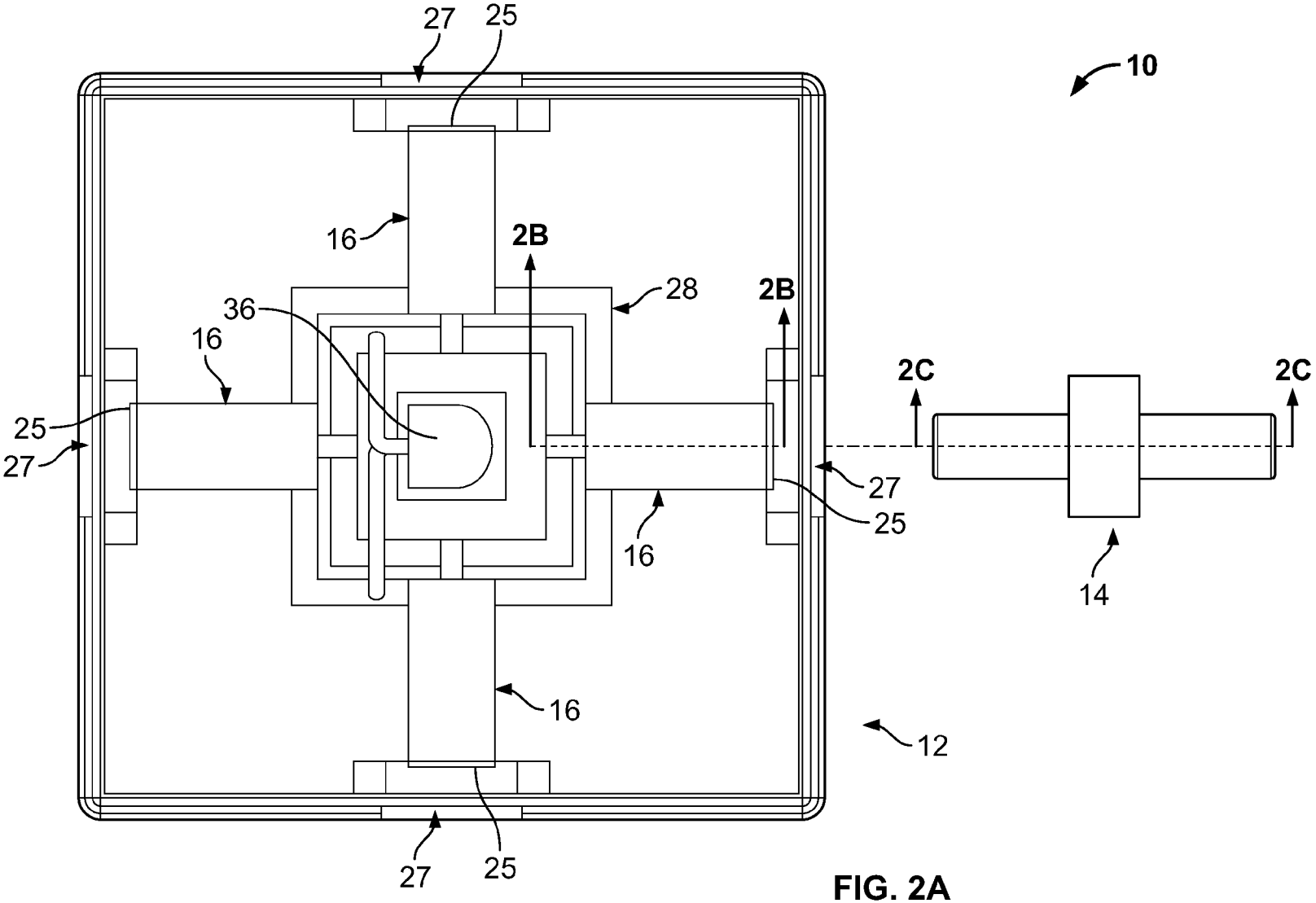
FIG. 2A is a top plan view of the illumination module and coupler shown in FIG. 1 in exploded fashion, the power source having been omitted.

FIGS. 1 and 2A illustrate an illuminated toy construction kit 10, which is constructed in accordance with an embodiment of the present invention. The kit 10 includes a plurality of illumination modules 12 (one of which is shown in FIGS. 1 and 2A), which may consist of a variety of shapes and sizes (see also, for example, FIGS. 7A through 7E). The kit 10 further includes a plurality of couplers 14, one of which is shown in FIGS. 1 and 2A. The couplers 14 may come in a variety of sizes and shapes (see also, for example, FIGS. 7F 71). Each of the illumination modules 12 includes a plurality of jacks 16, each being identical in size and shape to one another. As described in greater detail hereinbelow, the couplers 14 and the jacks 16 are adapted to facilitate the structural and electrical interconnection of the illumination modules 12 for the assembly of a variety of illuminated constructs and structures (see, for example, FIG. 8).

Referring specifically to FIG. 1, the illumination module 12 includes upper and lower casings 18, 20 that are sized and shaped to interconnect with each other to form a housing 22. The upper and lower casings 18, 20 have abutting arcuate lugs 24*a*, 24*b*, respectively, that cooperate to cradle a receptacle (i.e., receiving) end 25 of a corresponding one of the jacks 16 such that the receptacle end 25 is recessed within the housing 20. The receptacle end 25 of the jack functions as a female-like socket in a manner to be described in greater detail hereinafter. The housing 22 is adapted to support at least one printed circuit board assembly 26 ("the PCBA 26") in the interior thereof. The housing 22 also includes a plurality of openings 27, each of which is (i) provided in a corresponding sidewall of the housing 22 and (ii) aligned with a corresponding one of the jacks 16 in order to provide access for the couplers 14 to interconnect with the jacks 16 in a manner to be described hereinafter. In an embodiment, the upper and lower casings 18, 20 may be fabricated from transparent (i.e., clear) or translucent polymer material, and may be permanently joined together with an adhesive or glue to form the housing 22. Alternatively, the upper and lower casings 18, 20 may be fabricated with clips (not shown) to releasably join the upper and lower casings 18, 20 to one another to form the housing 22. As a further option, one of casings 18, 20 may be made from an opaque material, while the other is made from a transparent or translucent material.

Still referring to FIG. 1, the PCBA 26 includes a printed circuit board 28 ("the PCB 28") having conductive pathways or tracks 30, 32 positioned on a non-conductive substrate 34. In an embodiment, the tracks 30, 32 may be etched on the substrate 34 by conventional production methods and facilities known in the art. A light-emitting element 36, which includes power leads 38, 40, is mechanically supported by and electrically connected to the PCB 28. In an embodiment, the light-emitting element 36 is a conventional, color-varying light-emitting diode (LED). In other embodiments, the light-emitting element 36 can be any type of light bulb or similar device capable of generating light. The leads 38, 40 of the light-emitting element 36 may be soldered to the PCB 28 by conventional methods and facilities known in the art. More particularly, as shown in FIG. 1, the power lead 38 is soldered to the track 30, and the power lead 40 is soldered to the track 32.

In an embodiment, each of the jacks 16 is mechanically and electrically connected to the PCB 28 by conventional methods and facilities known in the art. More particularly, each of the jacks 16 is positioned between the PCB 28 and a corresponding one of the openings 27 of the housing 22. As indicated above, the receptacle end 25 of each of the jacks 16 is recessed within the housing 22. Referring to FIGS. 1 and 2B, each of the jacks 16 includes a tubular-shaped electrical conductor 42, which is fastened to the substrate 34 and is soldered to the track 32. Each of the jacks 16 further includes a pin-shaped electrical conductor 44, which is fastened to the substrate 34 and soldered to the track 30. An insulator 46 (see FIG. 2B) electrically separates the conductor 42 from the conductor 44.

The PCBA 26, by virtue of the its electrical conductivity, enables an electromotive force (emf) of, for example, +4.5 volts, that is applied across the conductors 42, 44 to appear across the leads 38, 40 of the light-emitting element 36, as well as across the conductors 42, 44 of each of the jacks 16. More particularly, emf may be applied across the conductors 42, 44 of one of the jacks 16 by a power plug P (see FIG. 1) that is connected to a direct current power supply PS (see FIG. 1), such as a battery, which can be located externally of a structure formed from the illumination modules 12 and the couplers 14 or which can be self-contained on such structure. The power plug P enables emf that appears across the anode (i.e., +) and the cathode (i.e., −) terminals of the battery or other direct current power supply to appear across all of the conductors 42, 44, respectively, of all of the jacks 16. In this manner, the illumination module 12 is "energized", the light-emitting element 36 is illuminated, and emf is applied across all of the conductors 42, 44, respectively, of all of the jacks 16. In other words, the conductors 42, 44 of the "energized" illumination module 12 may be utilized to energize other illumination modules 12 via the couplers 14. The use of the couplers 14 to structurally interconnect and electrically energize other illumination modules 12 is described hereinafter, following a more detailed description of the coupler 14 which is provided immediately below.

Referring to FIG. 2C, the coupler 14 has a pair of opposed male-like (i.e., plug) ends 47*a*, 47*b*, whose function will be described in greater detail hereinafter. The coupler 14 also includes a tubular-shaped inner conductor 48, which may be fabricated from metal, a tubular-shaped outer conductor 50, which may be fabricated from metal (e.g., zinc coated brass), and a tubular-shaped insulator 52, which separates the inner and outer conductors 48, 50 from one another. The insulator 52 may be fabricated from a polymer, such as PVC or polyurethane.

In an embodiment, a collar-like grip 54 is over-molded on the center of the outer conductor 50 of the coupler 14. The grip 54, which facilitates the handling of the coupler 14, may be fabricated from a polymer, such as PVC or polyurethane. In an embodiment, the grip 54 is in the shape of a ring, having a size and shape that enables it to fit snugly within two contiguously positioned adjacent or substantially abutting) openings 27 of two contiguously positioned (i.e., adjacent or substantially abutting) illumination modules 12, thereby providing structural stabilization and electrical continuity to the interconnected illumination modules 12 (see, for example, FIGS. 3 and 9C), which modules would be rotatable relative to the coupler 14 and hence relative to each other.

Figure 15:
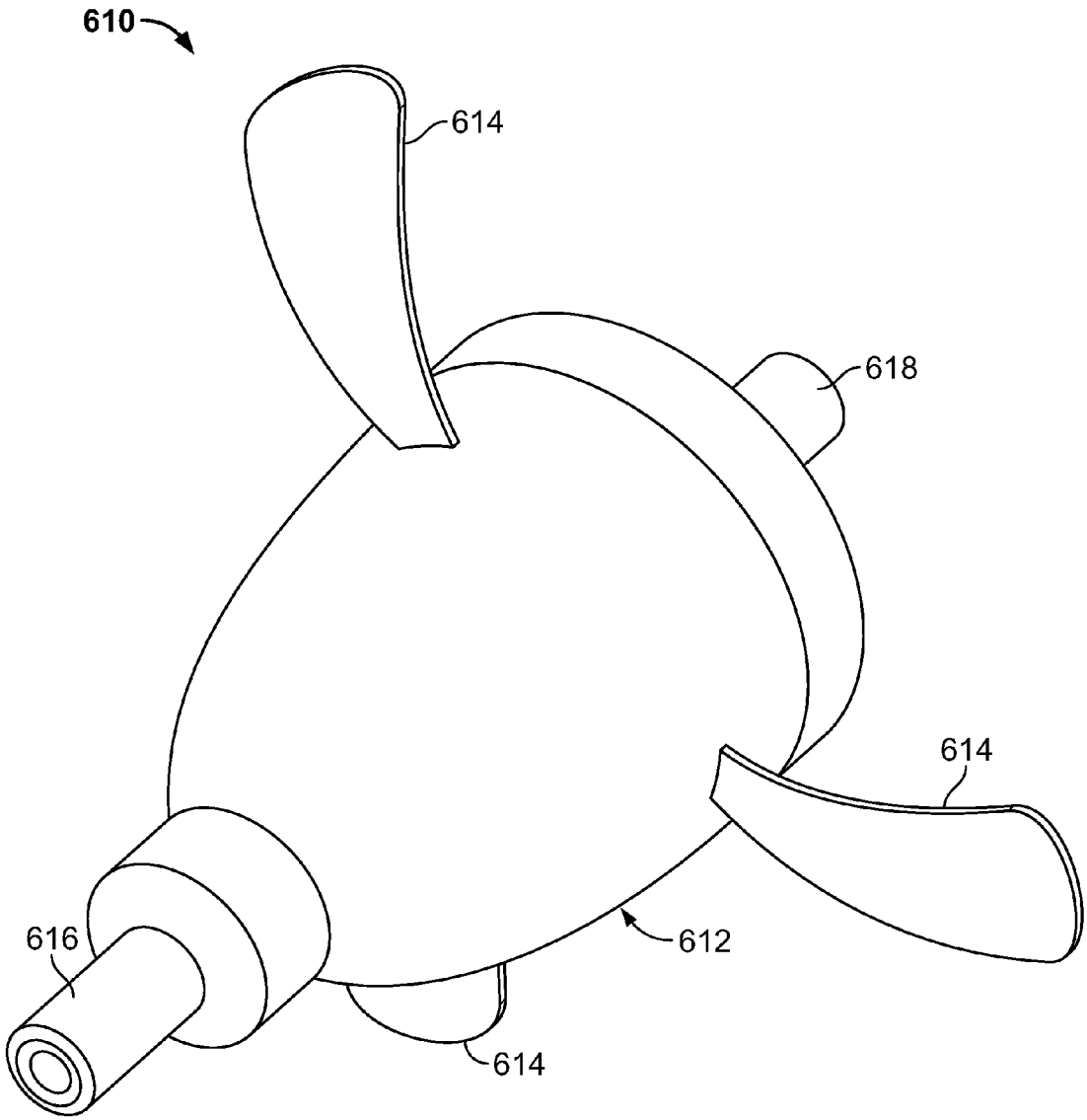
FIG. 15 is a top perspective view of a coupler which is in the form of a propeller and which functions as a non-illumination module.

In an embodiment, the length of the grip 54 is elongated in the longitudinal direction (see FIGS. 3 and 7J) so that a portion of its exterior surface is revealed between two interconnected illumination modules 12, which would therefore be maintained in a spaced-apart relationship by the elongated grip. The exposed portion of the elongated grip may also be formed with decorative designs (see, for example, the three-bladed propeller shown in FIG. 15). Such a coupler may, therefore, serve as a non-illumination module that could be utilized in conjunction with the illumination modules 12, as well as with other compatible non-illumination modules, such as LEGO® brick elements, as will be described in greater detail hereinbelow.

With reference to FIG. 2D, the couplers 14 and the jacks 16 are sized and shaped to have snug-fits when they are interconnected with one another, thereby providing additional structural stability to the combination. More particularly, the free end 25 of the jack 16 functions as a female-like socket to releasably and rotatably receive the male-like (i.e., plug) end 47*a* of the coupler 14. By virtue of (i) the electrical continuity of the inner conductor 48 of the coupler 14 being in contact with the electrical conductor 44 of the jack 16 and (ii) the electrical continuity of the outer conductor 50 of the coupler 14 being in contact with the electrical conductor 42 of the jack 16, each of the couplers 14 can function, in use, to convey emf across the conductors 42, 44 of the jacks 16 of two interconnected illumination modules 12.

Figure 3:
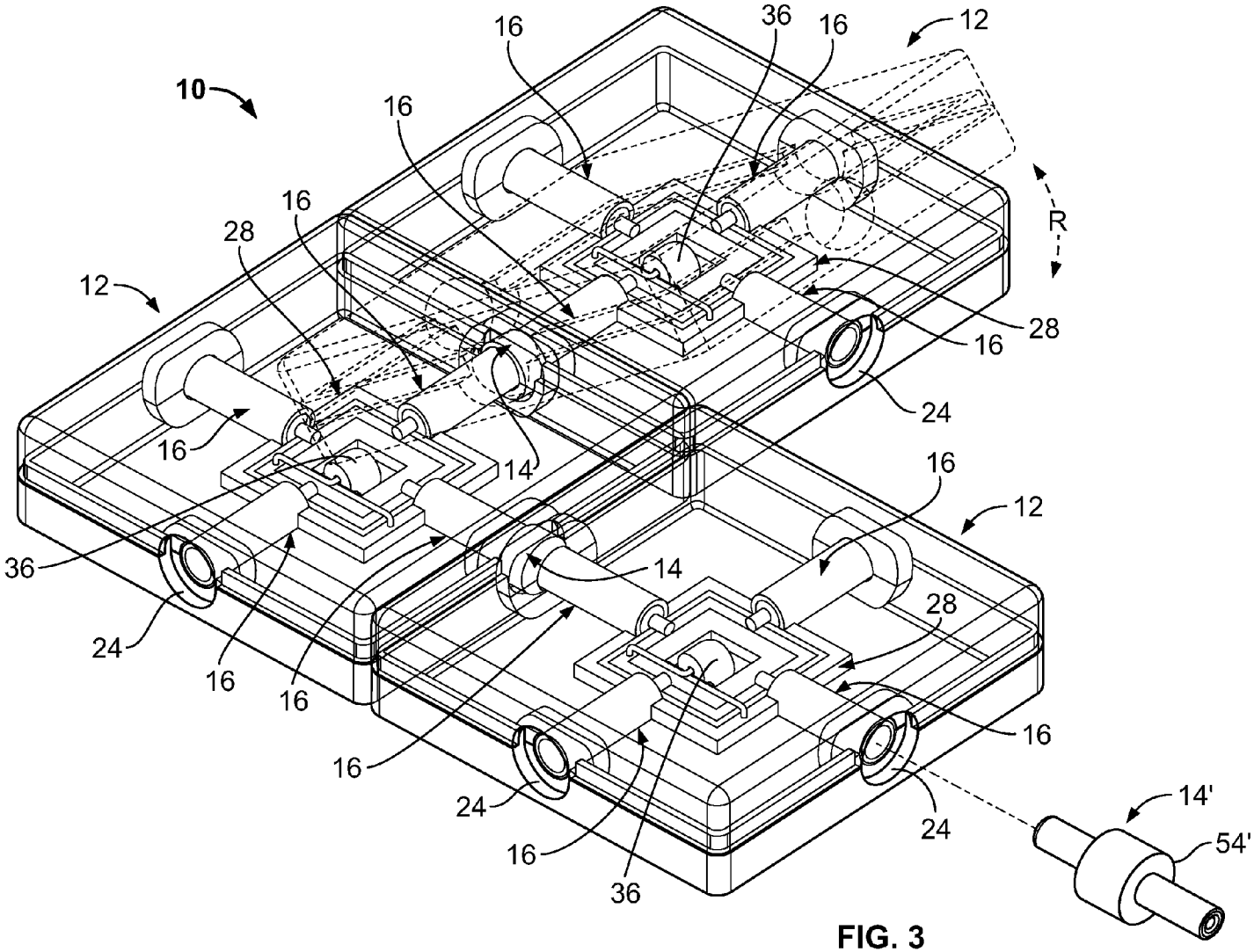
FIG. 3 is a top perspective view of an assembly of three of the illumination modules shown in FIG. 1, the modules being ganged together by a pair of the couplers shown in FIG. 1 with another coupler shown in exploded fashion.

FIG. 3 illustrates an assembly made from the toy construction kit 10, which assembly includes three of the illumination modules 12 interconnected by two of the couplers 14, which function as mechanical linkages. Assuming that at least one of the illumination modules 12 is energized in the manner described hereinabove, the other two modules 12 are energized as a result of their interconnection via the couplers 14, which also function as electrical conduits to transfer electric power between all of the interconnected illumination modules 12 such that all three of the light-emitting elements 36 can be simultaneously illuminated. As shown in FIG. 3, the illumination modules 12 are oriented such that their planar surfaces are in the same plane (i.e., they are coplanar), forming a relatively flat structure. In another embodiment, which is represented in phantom in FIG. 3, the couplers 14 permit two contiguously positioned (i.e., adjacent or substantially abutting) illumination modules 12 to be rotated relative to one another, in the direction of the arrow R, thereby expanding the possibilities of constructing various types of constructs and structures with the kit 10. The coupler 14', which is shown in exploded fashion, has an elongated grip 54' as described hereinabove.

FIGS. 4-8, FIGS. 9A-9C, FIGS. 10A and 10B, and FIGS. 11A and 11B depict alternate embodiments of the present invention. Elements illustrated in FIGS. 4-8, FIGS. 9A-9C, FIGS. 10A and 10B, and FIGS. 11A and 11B, which correspond either identically or substantially to the elements described above with respect to the embodiment shown in FIGS. 1 through 3, are designated by corresponding reference numerals increased by one hundred, two hundred, three hundred and four hundred, respectively. Unless otherwise stated, the embodiments shown by FIGS. 4-8, FIGS. 9A-9C, FIGS. 10A and 10B, and FIGS. 11A and 11B are constructed and assembled is in the same basic manner as the embodiment shown by FIGS. 1-3.

FIGS. 4-8 illustrate an illuminated toy construction kit 110 constructed in accordance with an embodiment of the present invention. The kit 110 includes a plurality of illumination modules 112 (one of which is shown), which can come in a variety of shapes and sizes (see also, for example, FIGS. 7A through 7E). In addition, the kit 110 includes a plurality of couplers 114, which can come in a variety of shapes and sizes (see also, for example, FIGS. 7F through 7J) and which facilitate the structural and electrical interconnection of the illumination modules 112, thereby permitting the assembly of a variety of illuminated constructs and structures (see, for example, FIG. 8). Each of the illumination modules 112 includes a plurality of recessed jacks 116, each being identical in size and shape to one another. The illumination module 112 includes upper and lower casings 118, 120 which, when interconnected, support at least one printed circuit board assembly 126 ("the PCBA 126") via upper mounting standoffs 127*a* and lower mounting standoffs 127*b*.

Figure 5A:
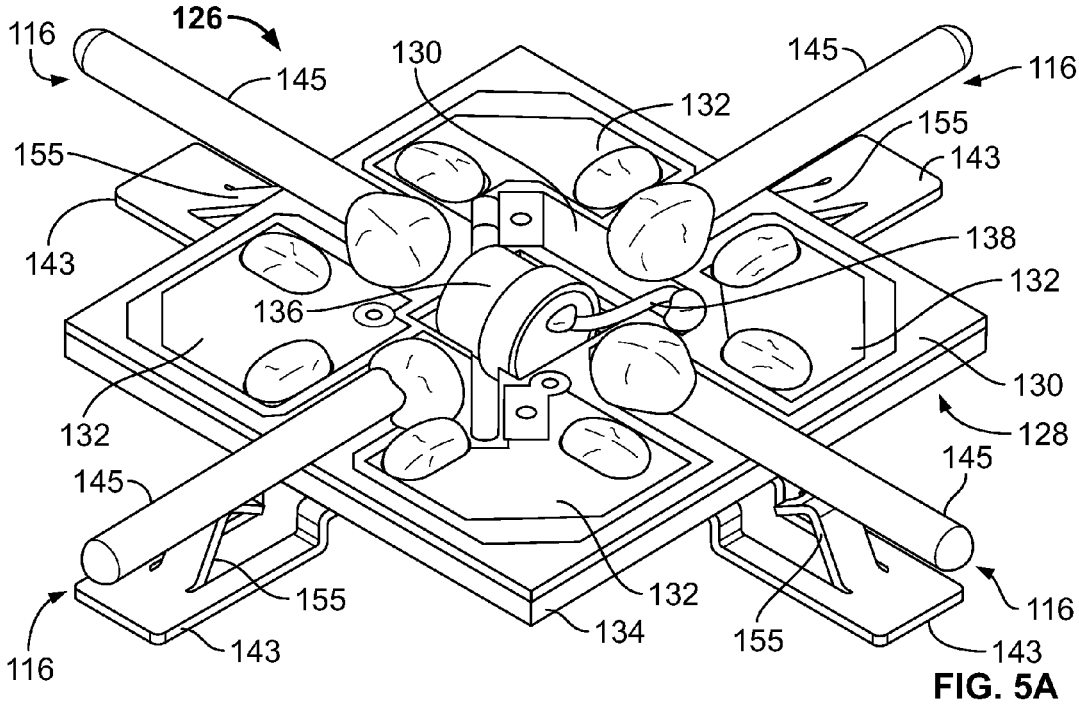
FIG. 5A is a top perspective view of a printed circuit board assembly employed by the illumination module shown in FIG. 4.
Figure 5B:
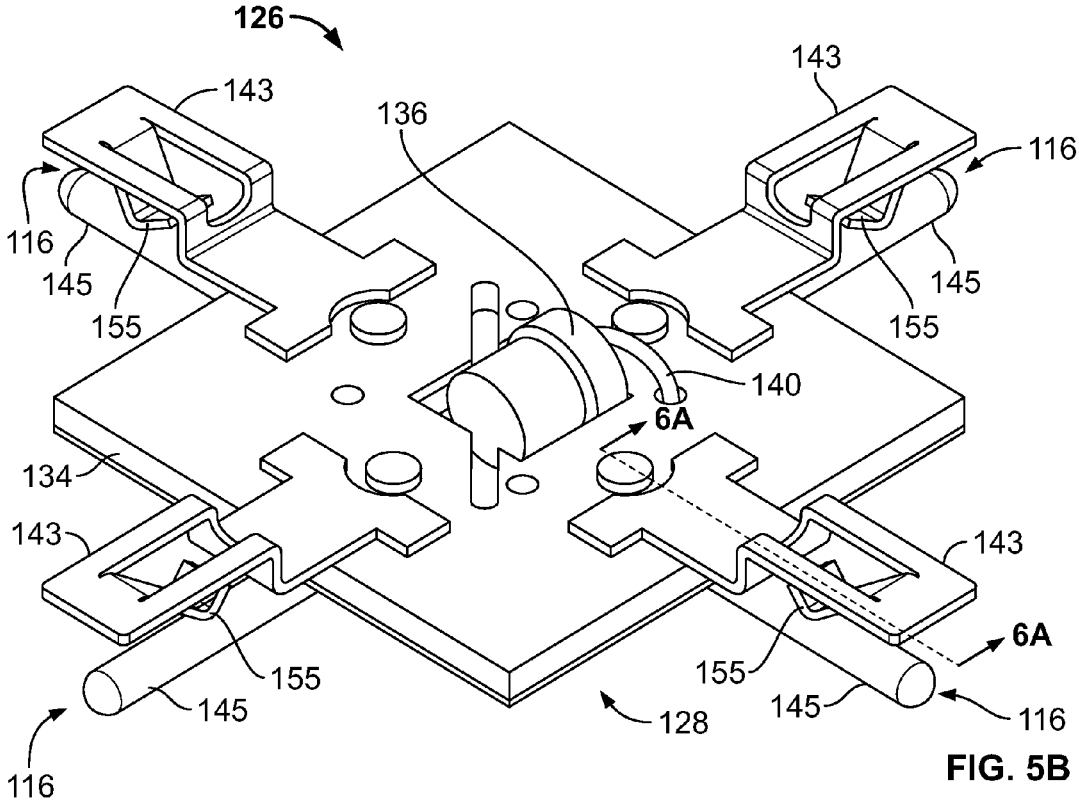
FIG. 5B is a bottom perspective of the printed circuit board assembly shown in FIG. 5A.

Referring specifically to FIGS. 5A and 5B, the PCBA 126 includes a printed circuit board (PCB) 128 having electrically conductive pathways or tracks 130, 132 positioned on an electrically non-conductive substrate 134. In an embodiment, a light-emitting element 136, which includes power leads 138, 140, is mechanically supported by and electrically connected to the PCB 128. In an embodiment, the power lead 138 is soldered to the track 130, and the power lead 140 is soldered to the track 132. Each of the jacks 116 is mechanically and electrically connected to the PCB 128.

Referring to FIGS. 5A-6A, each of the jacks 116 includes a conductor 143, which is fastened to the substrate 134 and soldered to the track 132. A spring clip 155 is formed on the conductor 143 of the jack 116. Each of the jacks 116 further includes a pin-shaped electrical conductor 145, which is fastened to the substrate 134 and soldered to the track 130. It is noted that the conductors 143, 145 do not contact one another.

Referring to FIG. 6B, each of the couplers 114 includes a tubular-shaped inner conductor 148, a tubular-shaped outer conductor 150, and a tubular-spaced insulator 152, which separates the inner and outer conductors 148, 150. In an embodiment, a grip 154 is over-molded on the center of the outer conductor 150 of the coupler 114. FIG. 6C illustrates the spring clip 155 of the jack 116 in snug contact with the conductor 150 of the coupler 114, and the conductor 145 of the jack 116 in snug contact with the inner conductor 148 of the coupler 114.

Figure 4:
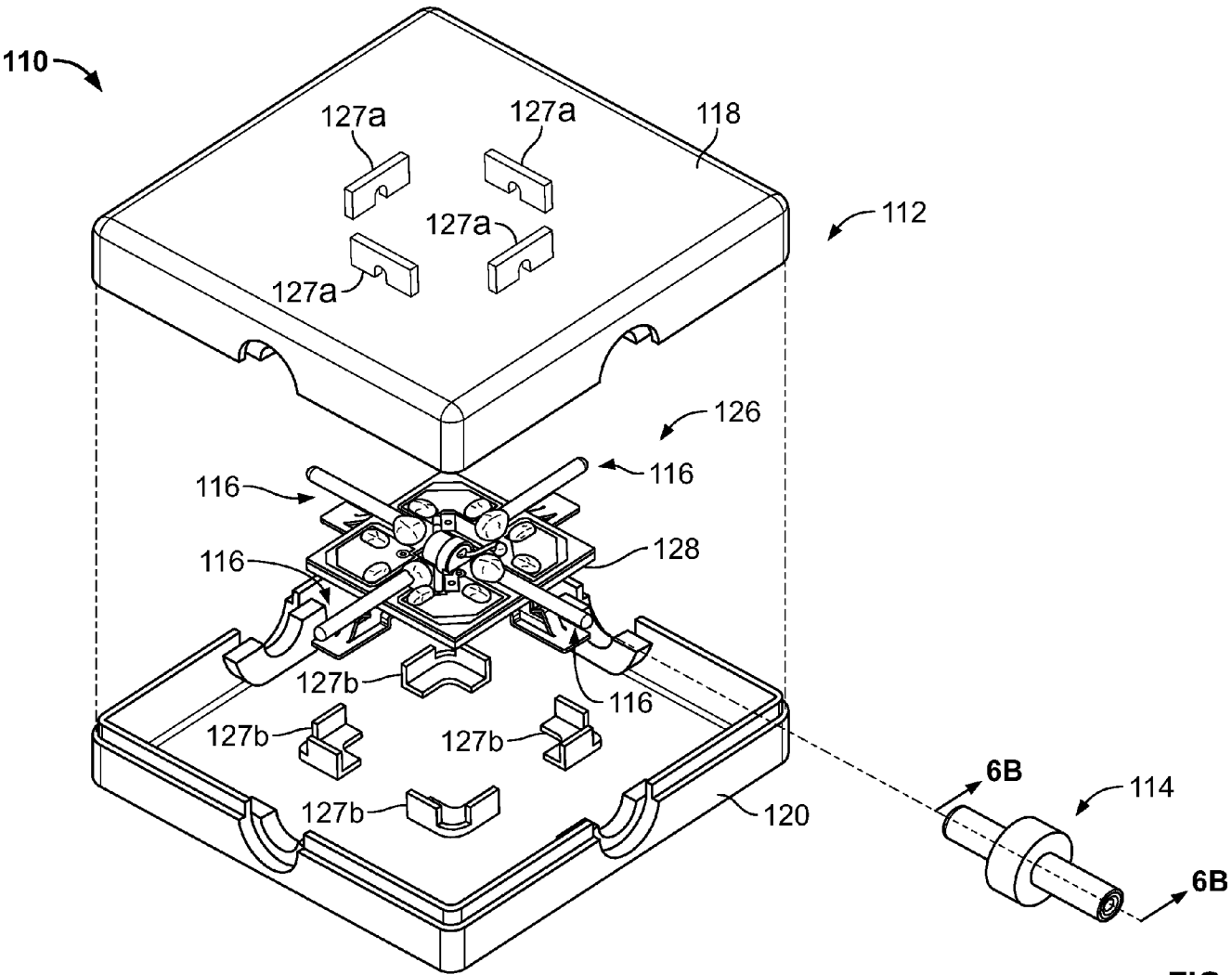
FIG. 4 is an exploded, top perspective view of an illumination module and coupler combination constructed in accordance with another embodiment of the present invention.
Figure 7A:
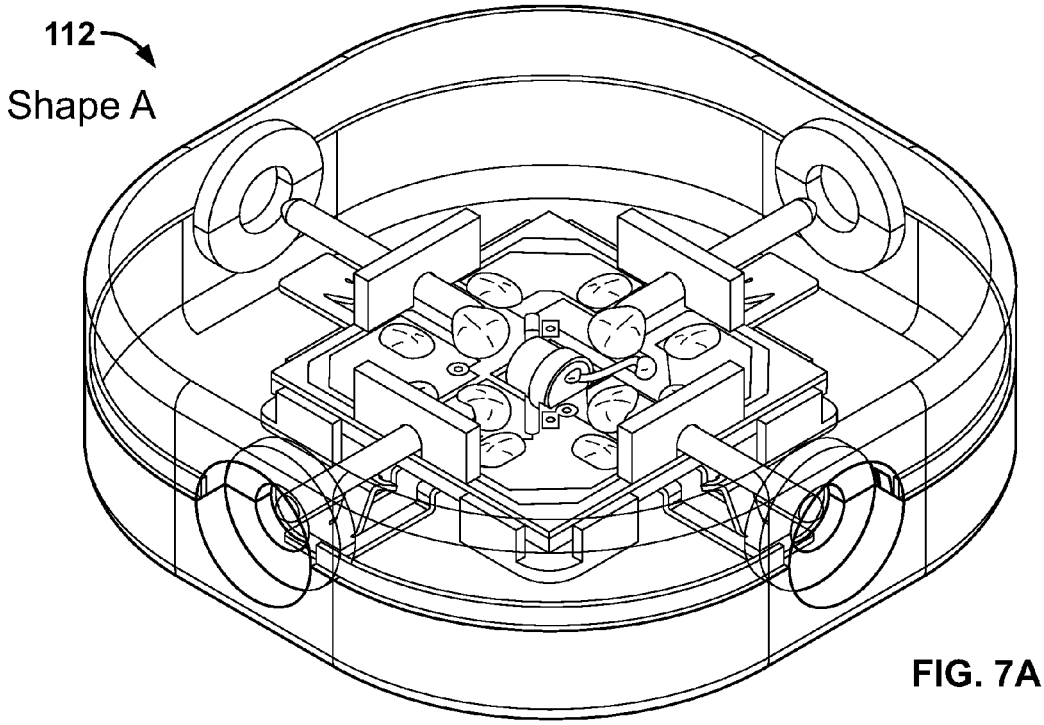
FIG. 7A is a perspective view of an embodiment of an illumination module having a construction similar to the embodiment of FIG. 4, except for its external shape.
Figure 7B:
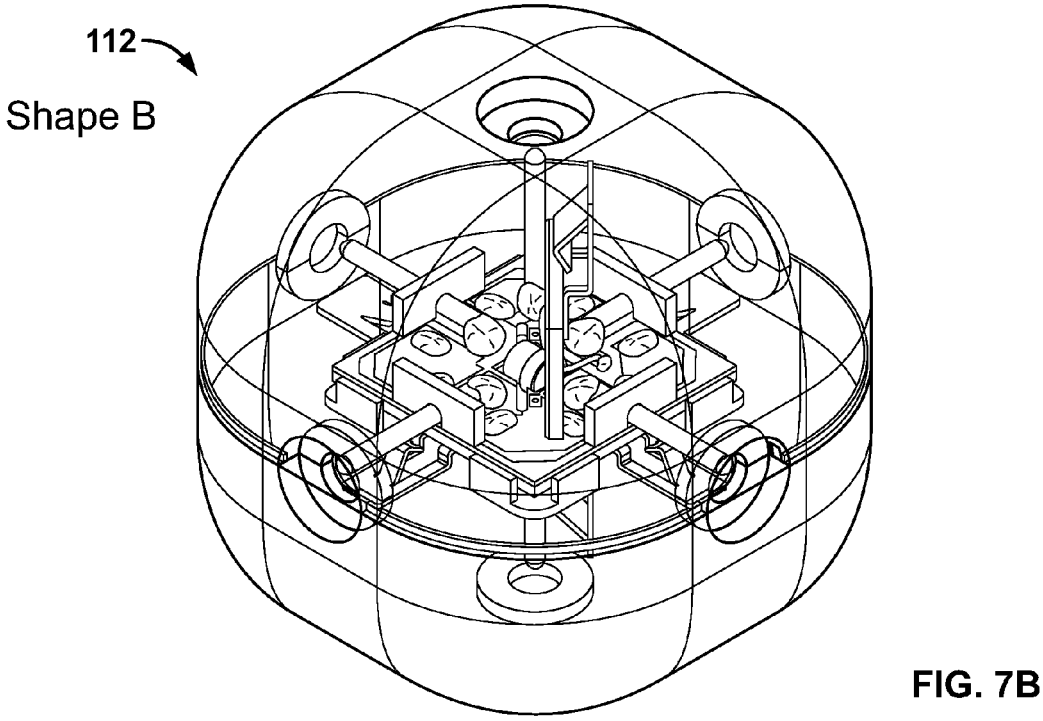
FIG. 7B is a perspective view of an embodiment of an illumination module having a construction similar to the embodiment of FIG. 4, except for its external shape and the addition of two more jacks.
Figure 7C:
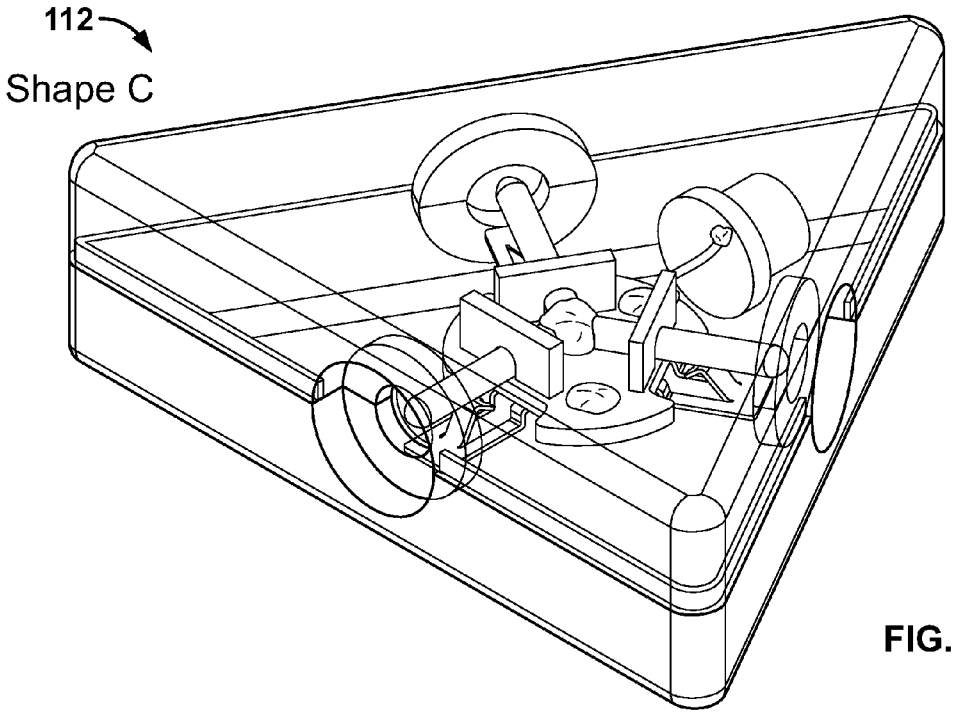
FIG. 7C is a perspective view of an embodiment of an illumination module having a construction similar to the embodiment of FIG. 4, except for its external shape and the deletion of one of the jacks.
Figure 7D:
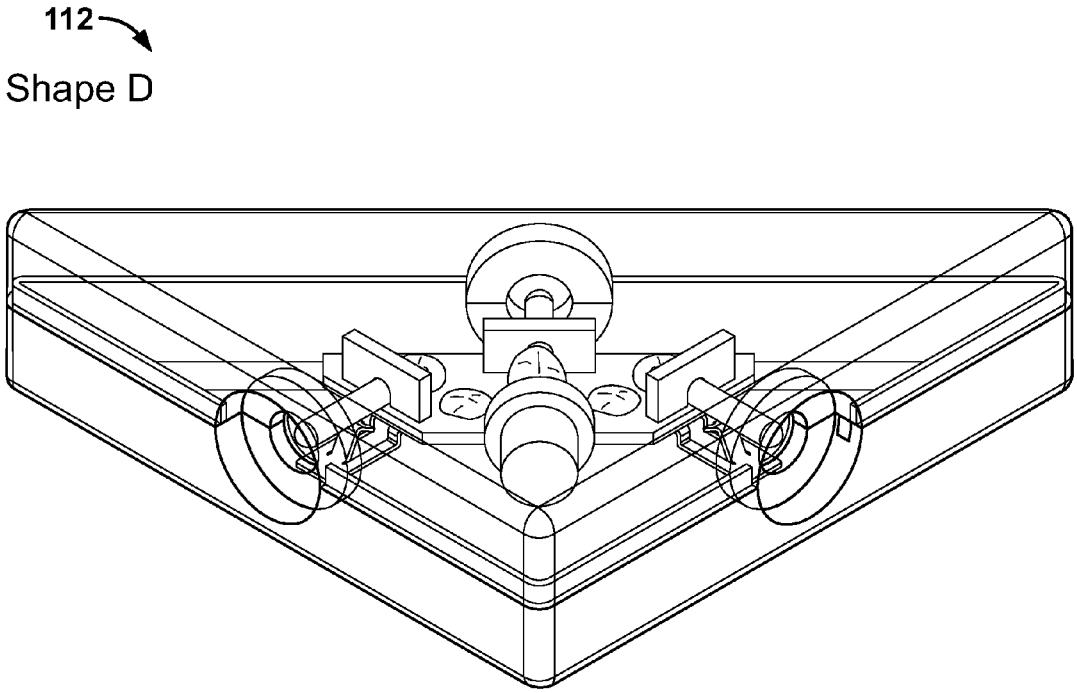
FIG. 7D is a perspective view of an embodiment of an illumination module similar to that of FIG. 7C, except for its external shape.
Figure 7E:
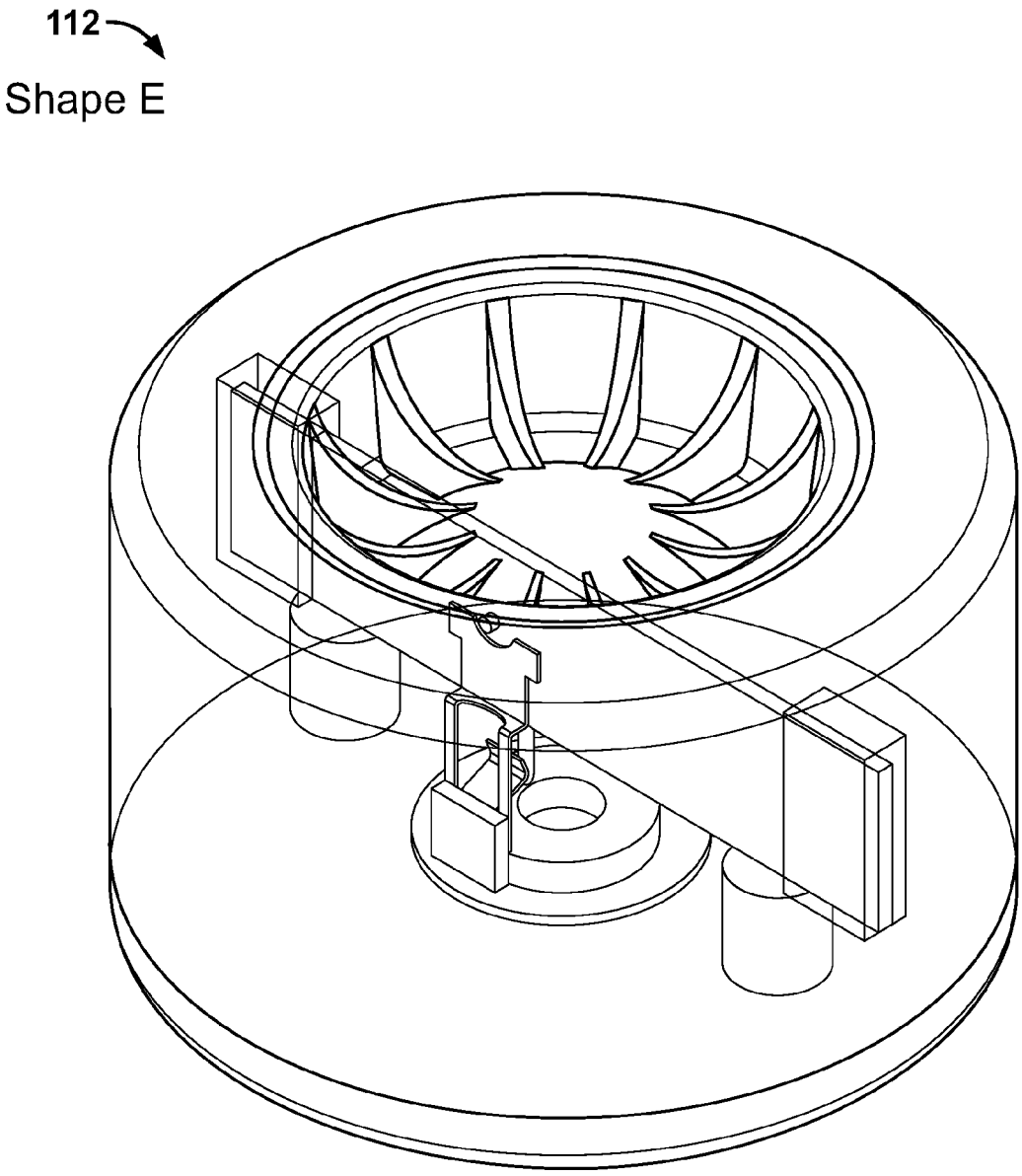
FIG. 7E is a perspective view of an embodiment of an illumination module having a wheel-like shape and a single jack.

In various embodiment's, the illuminated module 112 can come in various shapes and sizes, in addition to the rectangular shape shown by FIG. 4. For example, FIG. 7A illustrates the illumination module 112 having a rounded rectangular shape (Shape A); FIG. 7B shows the illumination module 112 having a rounded cubical shape (Shape B); FIG. 7C shows the illumination module 112 having the shape of an equilateral triangle (Shape C); FIG. 7D depicts the illumination module 112 having the shape of a right-triangle (Shape D); and FIG. 7E shows the illumination module 112 having a wheel-like shape (Shape E). It is understood that the illumination modules 112 may consist of various shapes and sizes in addition to those shown by FIGS. 7A through 7E, such as tubular and polygonal (e.g., pentagonal, hexagonal, octagonal, etc.). It is understood that each of the aforesaid different shaped illumination modules 112 will have appropriately positioned and recessed jacks 116 and corresponding openings (e.g., four of the jacks 116 and openings for Shape A; six of the jacks 116 and openings for Shape B; three of the jacks 116 and openings for Shapes C and D; one of the jacks 116 and opening for Shape E).

Figure 7F:
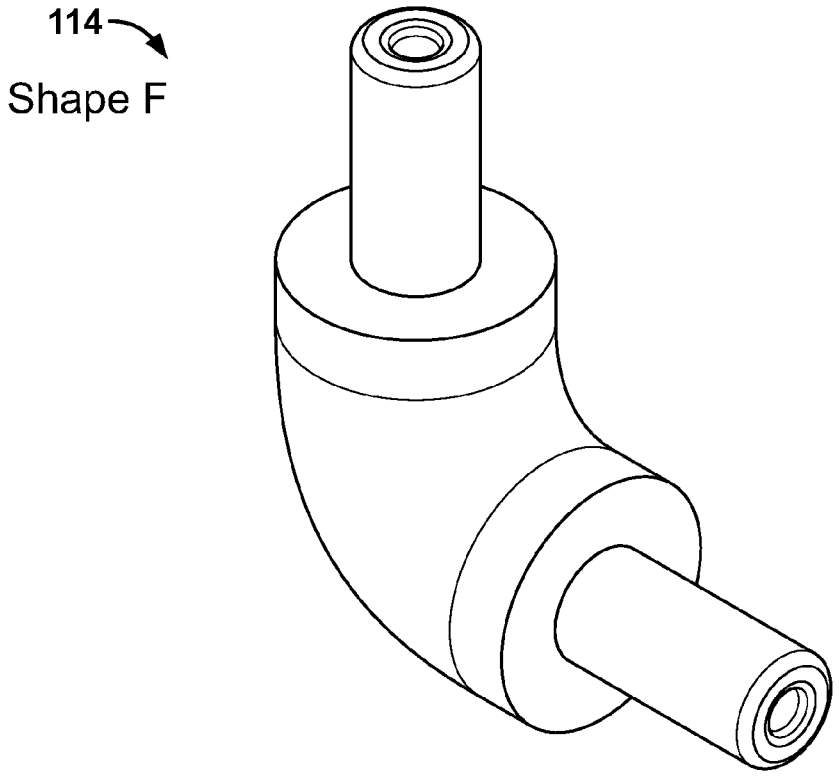
FIG. 7F is a perspective view of an embodiment of a coupler having a construction similar to the embodiments shown in FIGS. 1, 2A, 2C, 3, 4 and 6B, except for its external shape.
Figure 7G:
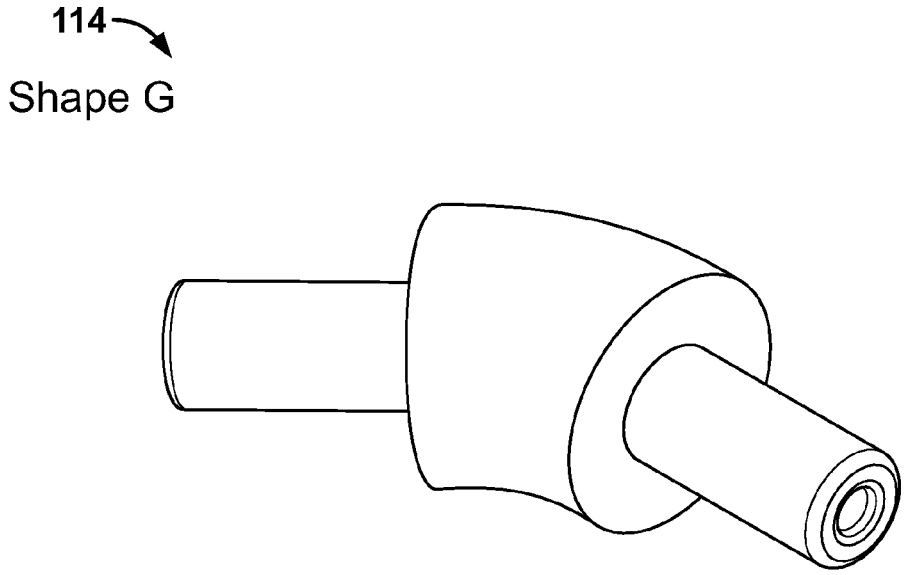
FIG. 7G is a perspective view of an embodiment of a coupler similar to that of FIG. 7F, except for its shape.
Figure 7H:
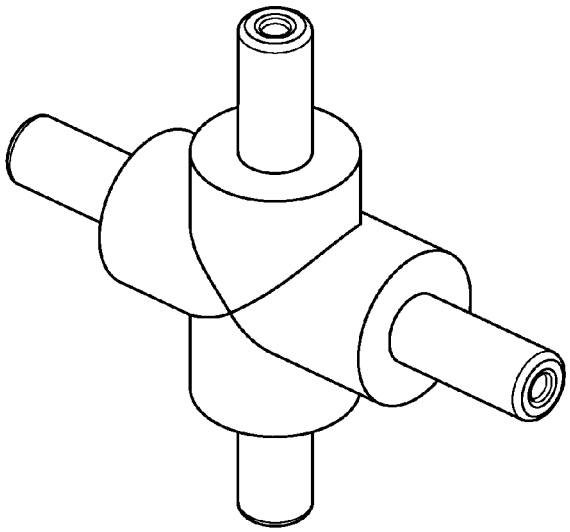
FIG. 7H is a perspective view of an embodiment of a coupler similar to the embodiments of FIGS. 1, 2A, 2C, 3, 4 and 6B, except for its external shape and the addition of two more plug ends.
Figure 7I:
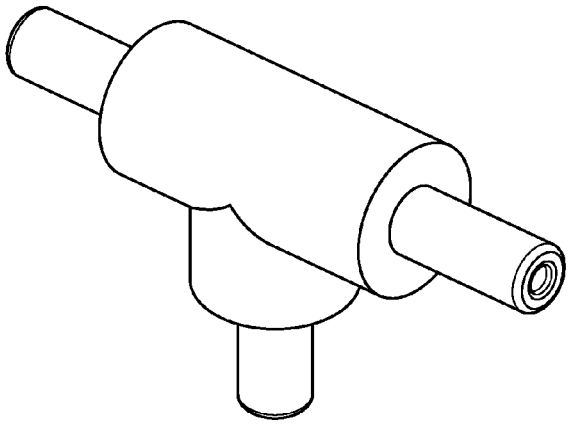
FIG. 7I is a perspective view of an embodiment of a coupler similar to the embodiments of FIGS. 1, 2A, 2C, 3, 4 and 6B, except for its external shape and the addition of one more plug end.
Figure 7J:
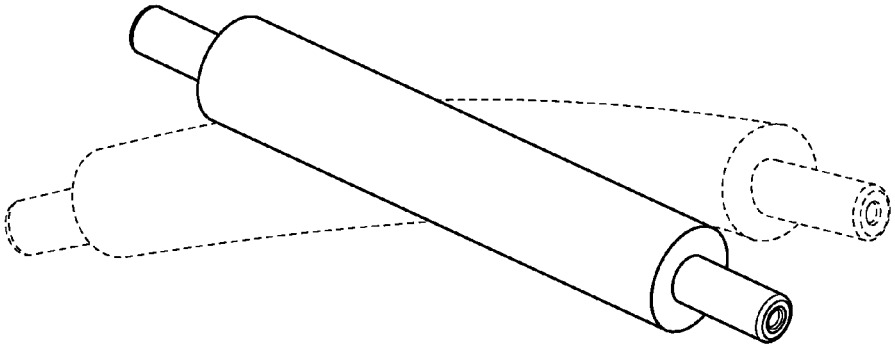
FIG. 7J is a perspective view of a coupler similar to the embodiments shown in FIGS. 1, 2A, 2C, 3, 4, and 6B, except for its shape, the coupler of FIG. 7J being elongated and having sufficient flexibility so that it can be bent into various different positions (two of which are shown in phantom)

Likewise, the couplers 114 may come in various shapes and sizes in addition to the linear-shape shown in FIG. 4 and FIGS. 6B and 6C. For instance, FIG. 7F illustrates the coupler 114 having a 90-degree angular (e.g., elbow) shape (Shape F); FIG. 7G illustrates the coupler 114 having a 45-degree angular (e.g., elbow) shape (Shape G); FIG. 7H illustrates the coupler 114 having the shape of a cross (Shape H); FIG. 7I illustrates the coupler 114 having a T-shape (Shape I); and FIG. 7J illustrates the coupler 114 having an elongated linear shape. It is understood that the couplers 114 may consist of various shapes and sizes in addition to those shown in FIGS. 7F though 7J. In another embodiment, the couplers 114 may include flexible elements (see FIG. 7J), such as hinges and/or rubber portions, that enable the couplers 114 to be varied in shape and orientation.

Figure 8:
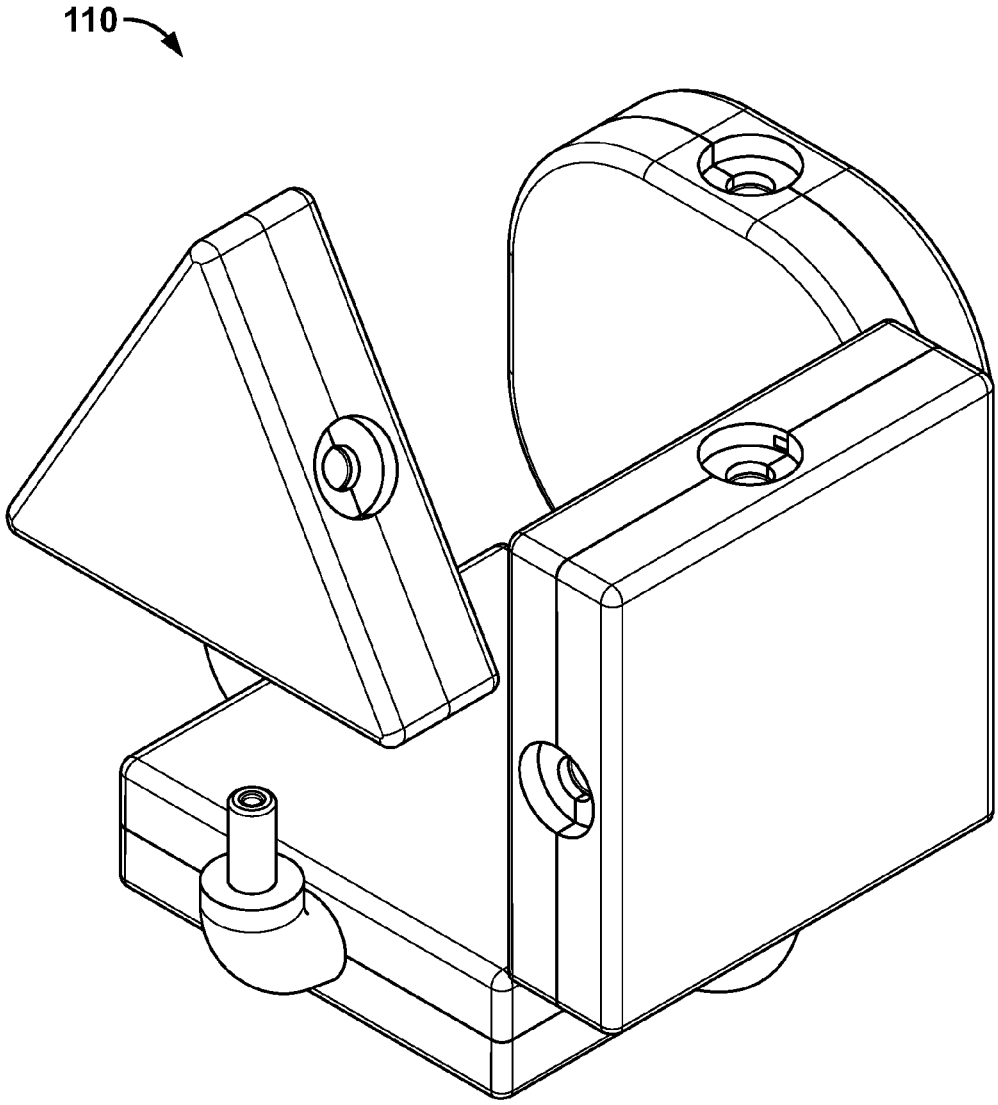
FIG. 8 is a perspective view of a constructed assembly utilizing the illumination modules shown in FIGS. 4, 7A and 7C, and the couplers shown in FIG. 7F.

As indicated above, FIG. 8 shows an example of a three-dimensional assembly of the illumination modules 112 that are shown in FIG. 4 and FIGS. 7A and 7C, and the couplers 114 that are shown in FIG. 7F. It should be noted that the individual modules 112 are arranged in various different planes.

Figures 9A, 9B:
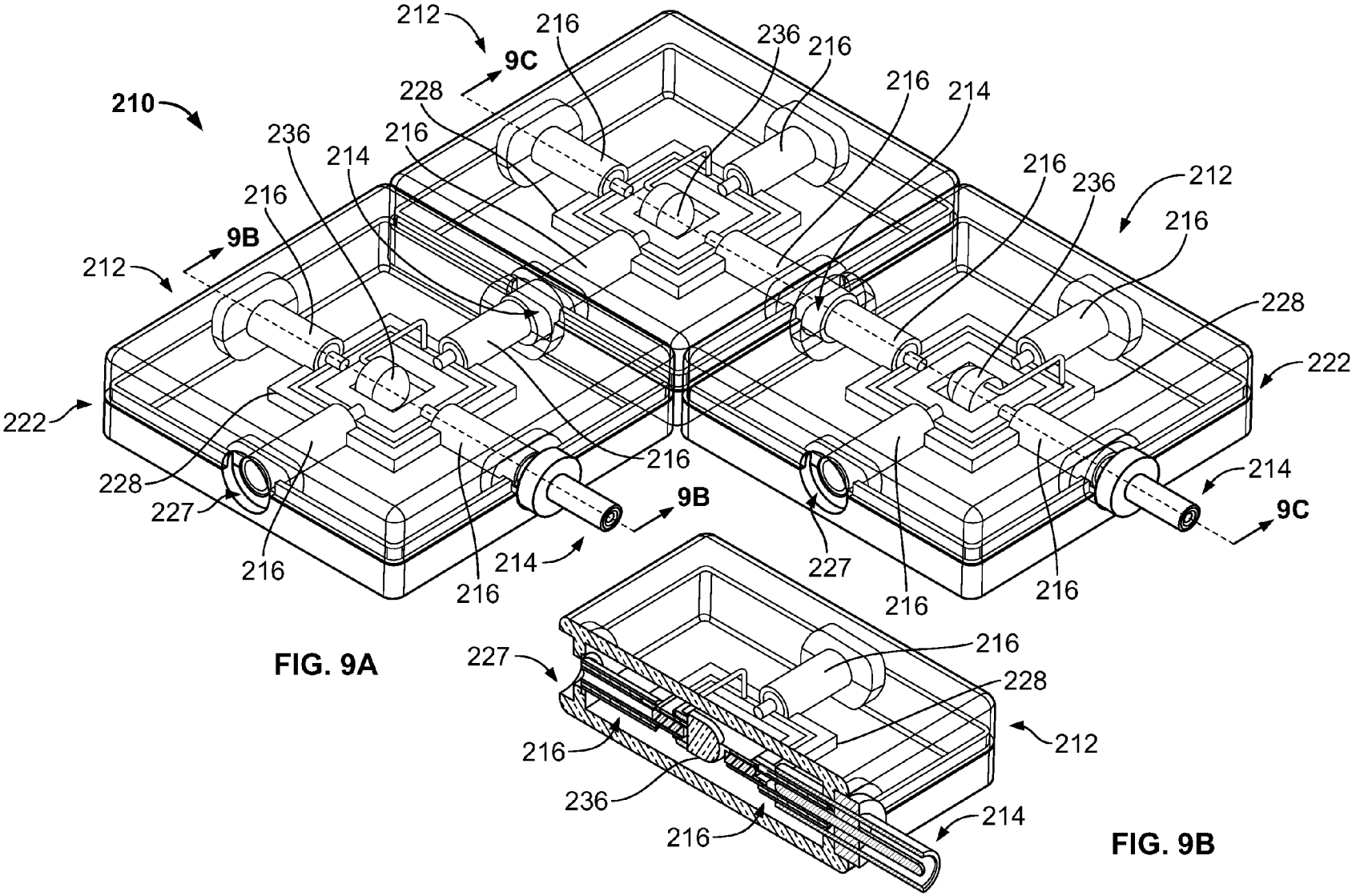
FIG. 9A is a top perspective view of an assembly of three illumination modules and four couplers, the modules being similar to those in FIGS. 1-3 and the couplers being similar to those depicted in FIGS. 1-3.
FIG. 9B is a perspective cross-sectional view taken along section line 9B-9B of FIG. 9A and looking in the direction of the arrows.

FIG. 9A illustrates an illuminated toy construction kit 210 constructed in accordance with another embodiment of the present invention. The kit 210 includes a plurality of illumination modules 212 and a plurality of couplers 214. The couplers 214, which can come in a variety of sizes and shapes, facilitate the structural and electrical interconnection of the illumination modules 212, thereby permitting the assembly of a variety of illuminated constructs and structures. Each of the illumination modules 212 to includes a plurality of recessed jacks 216, each being identical in size and shape to one another. Each of the illumination modules 212 also includes a housing 222 having a plurality of openings 227. At least one printed circuit board 228 ("the PCB 228"), which has at least one light-emitting element 236 mounted thereon, is supported within the housing 222.

Figure 9C:
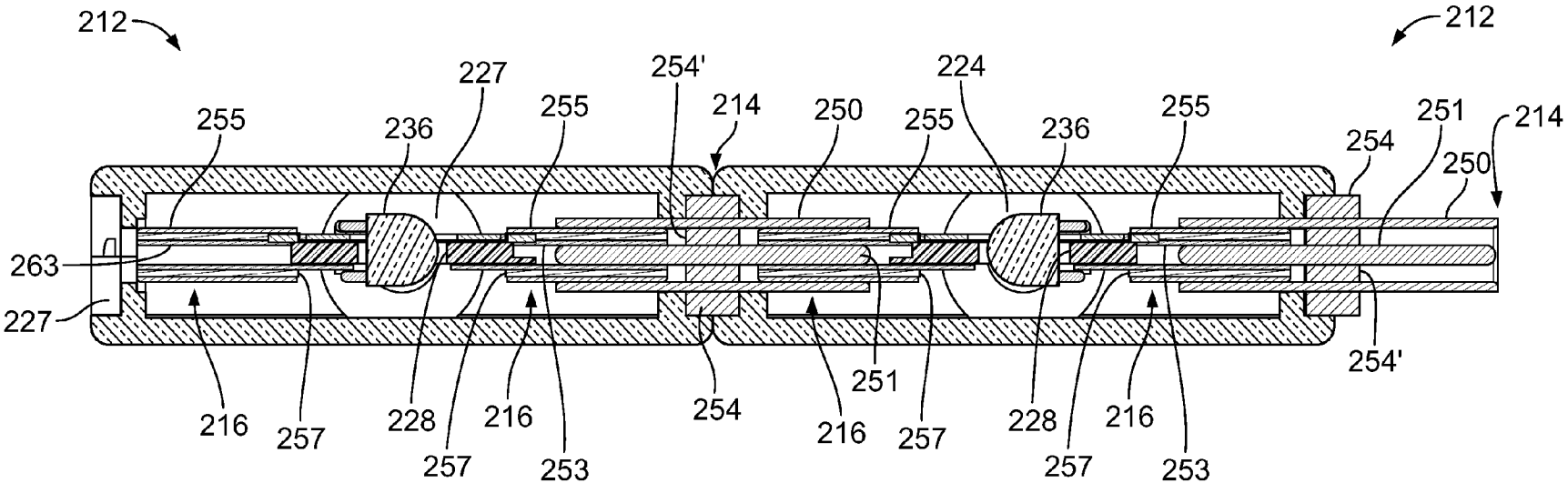
FIG. 9C is a side cross-sectional view taken along section 9C-9C of FIG. 9A and looking in the direction of the arrows.

FIGS. 9B and 9C depict the components of each of the couplers 214 and each of the jacks 216, and the configuration of the interconnection between one of the couplers 214 and one of the jacks 216 when they are interconnected. More particularly, the coupler 214 includes a tubular-shaped outer conductor 250 and a pin-shaped inner conductor 251, which replaces the tubular-shaped inner conductor 48 of the embodiment shown in FIGS. 1-3. In an embodiment, a grip 254 is over-molded on the center of the outer conductor 250 of the coupler 214, while an inner ring-like insulator 254' supports the inner conductor 251 within the outer conductor 250. The jack 216, which is mechanically and electrically fastened to the PCB 228, includes a tubular-shaped inner conductor 253, a tubular-shaped outer conductor 255, and a tubular-shaped insulator 257, which separates the inner and outer conductors 253, 255. FIG. 9C illustrates the outer conductor 250 of the coupler 214 in snug contact with the outer conductor 255 of the jack 216 and the inner conductor 251 of the coupler 214 in snug contact with inner conductor 253 of the jack 216.

Figure 10B:
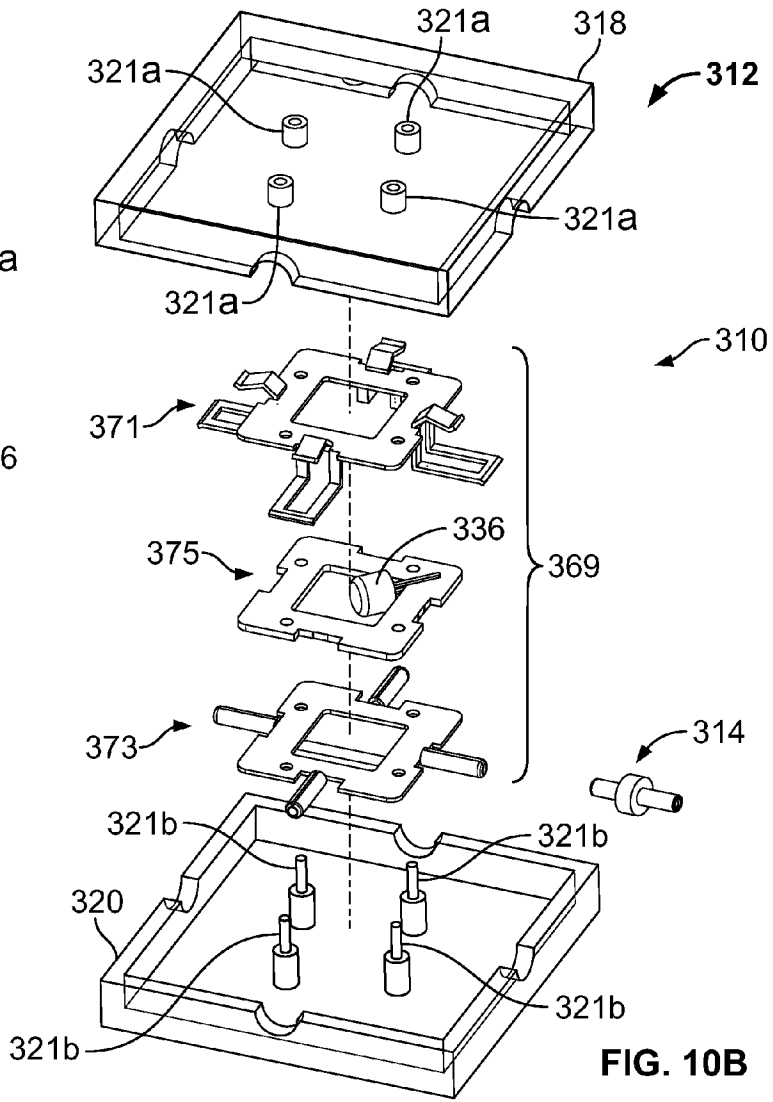
FIG. 10B is an exploded, top perspective view similar to FIG. 10A, except that an internal anode/cathode plate assembly is shown in an exploded fashion as well.
Figure 10A:
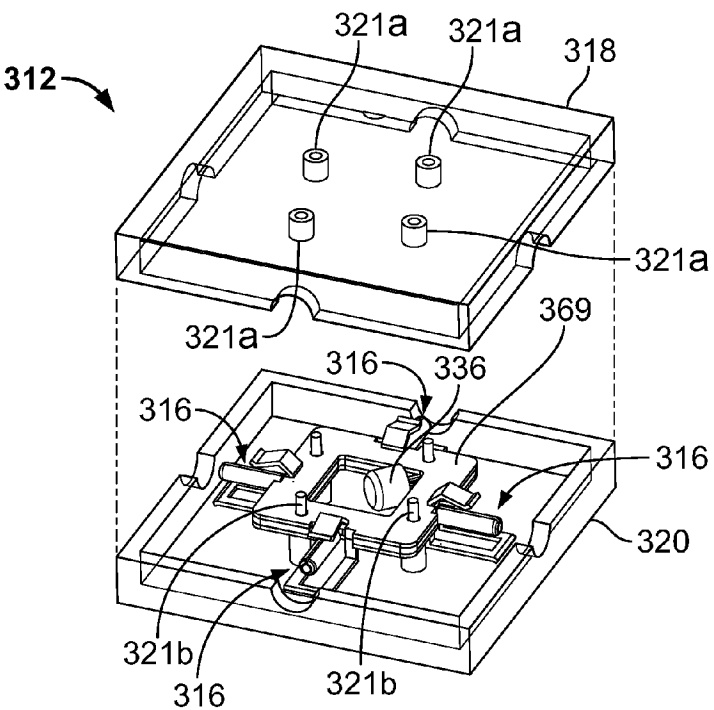
FIG. 10A is an exploded, top perspective view of an illumination module and coupler combination constructed in accordance with yet another embodiment of the present invention.

FIGS. 10A and 10B illustrate an illuminated toy construction kit 310 constructed in accordance with another embodiment of the present invention. The kit 310 includes a plurality of illumination modules 312 (one of which is shown) and a plurality of couplers 314 (one of which is shown). The couplers 314 facilitate the structural and electrical interconnection of the illumination modules 312, thereby permitting the assembly of a variety of illuminated constructs and structures. Each of the illumination modules 312 to includes a plurality of recessed jacks 316, each being identical in size and shape to one another. Each of the illumination modules 312 also includes upper and lower casings 318, 320, which have upper mounting posts 321*a* and lower mounting posts 321*b*, respectively. When the upper and lower casings 318, 320 are interconnected, the upper mounting posts 321*a* cooperate with the lower mounting posts 321*b* to support an assembly 369 comprising cathode and anode plates 371, 373, respectively, and an electrical insulating layer 375 sandwiched therebetween. A light-emitting element 336 is supported by the insulating layer 375. The assembly 369 replaces the PCBA 26 of the embodiment shown in FIGS. 1-3. Alternatively, the insulating layer 375 could be eliminated and replaced with an air space created by a plurality of electric insulating spacers interposed between the cathode and anode plates 371, 373, respectively, in which case the light-emitting element 336 would be mechanically and electrically connected to such plates.

Figure 11B:
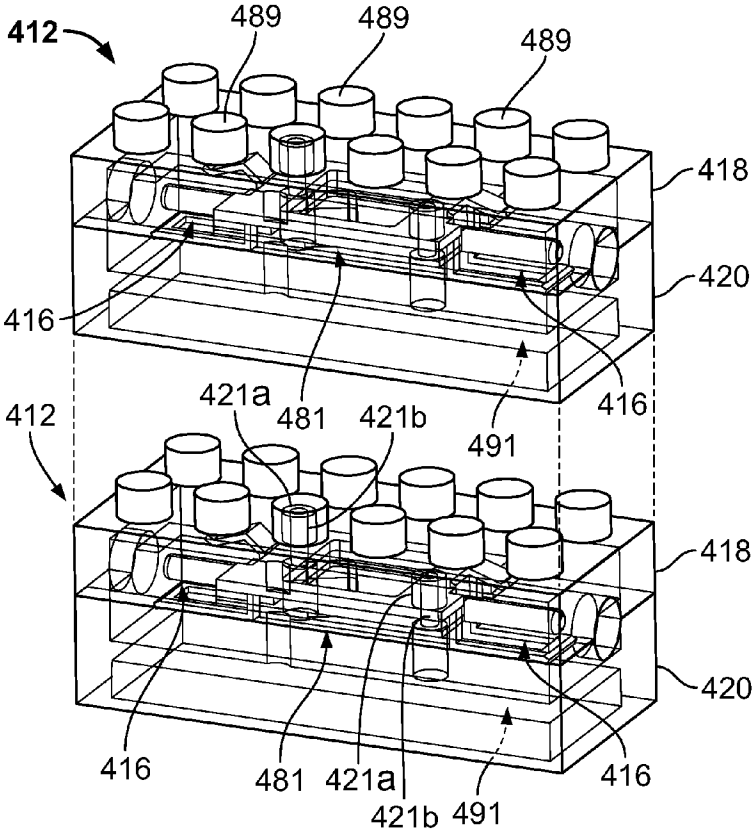
FIG. 11B is an exploded, top perspective view of two of the illumination modules shown in FIG. 11A.
Figure 11A:
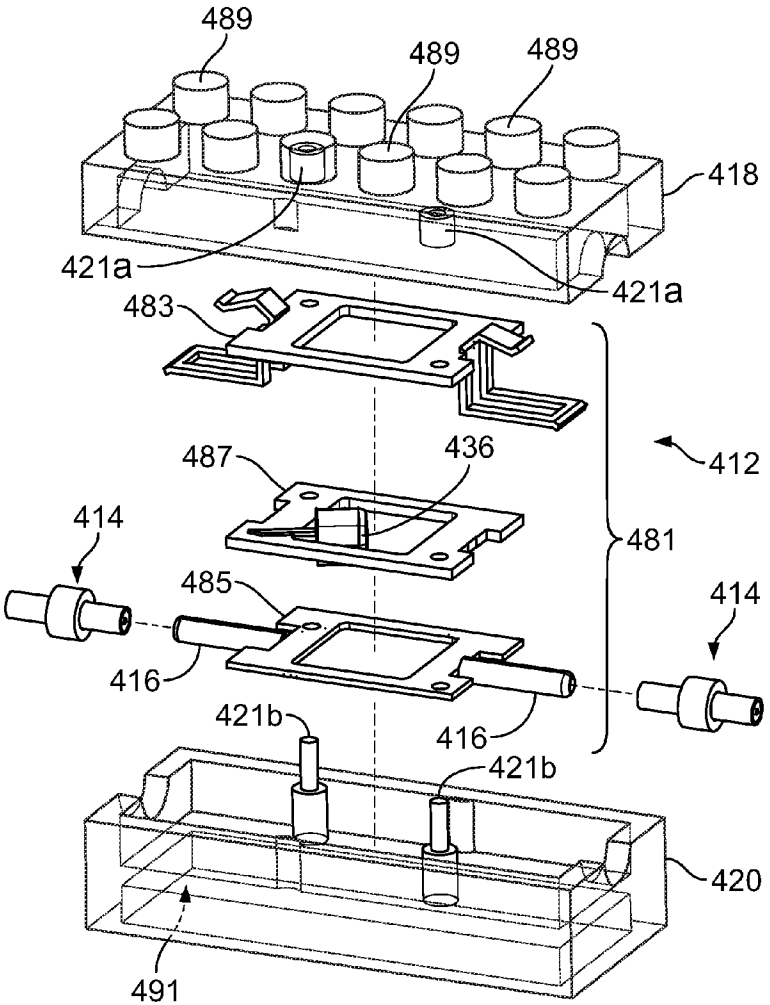
FIG. 11A is an exploded, top perspective view of an illumination module and coupler combination constructed in accordance with a still further embodiment of the present invention.

FIGS. 11A and 11B illustrate an illuminated toy construction kit 410 constructed in accordance with another embodiment of the present invention. The kit 410 includes a plurality of illumination modules 412 and a plurality of couplers 414. The couplers 414 facilitate the structural and electrical interconnection of the illumination modules 412, thereby permitting the assembly of a variety of illuminated constructs and structures. Each of the illumination modules 412 includes a plurality of recessed jacks 416, each being identical in size and shape to one another. Each of the illumination modules 412 also includes upper and lower casings 418, 420, which have upper mounting retainers 421*a* and lower mounting retainers 421*b*, respectively. When the upper and lower casings 418, 420 are interconnected, the upper mounting retainers 421*a* cooperate with the lower mounting retainers 421*b* to support an assembly 481 comprising cathode and anode plates 483, 485, respectively, and an electrical Insulating layer 487 sandwiched therebetween. The insulating layer 487 supports alight-emitting element 436.

In an embodiment, the upper casing 418 of the illumination module 412 includes a plurality of projections 489 extending outwardly therefrom. Likewise, the lower casing 420 of the illumination module 412 includes at least one receptacle 491 formed therein. The receptacle 491 is sized and shaped to snugly receive the projections 489 of the upper casing 418 of another illumination module 412. Additionally, or alternatively, the illumination modules 412 may be assembled with elements of other toy construction components, such as LEGO® brick elements (not shown), which typically would not have their own self-contained light source, but which would have complementary projections and/or receptacles that are capable, of mating with the projections 489 and/or the receptacle 491 of the illumination module 412. More particularly, projections on other toy construction components may be releasably received in the receptacle 491 of the lower casing 420. Likewise, the projections 489 of the upper casing 418 may be releasably inserted in a mating receptacle in another toy construction component, which, if transparent or translucent, could be used to transmit light emanating from the illumination module 412 to additional, otherwise non-illuminated, toy construction components.

Figure 12:
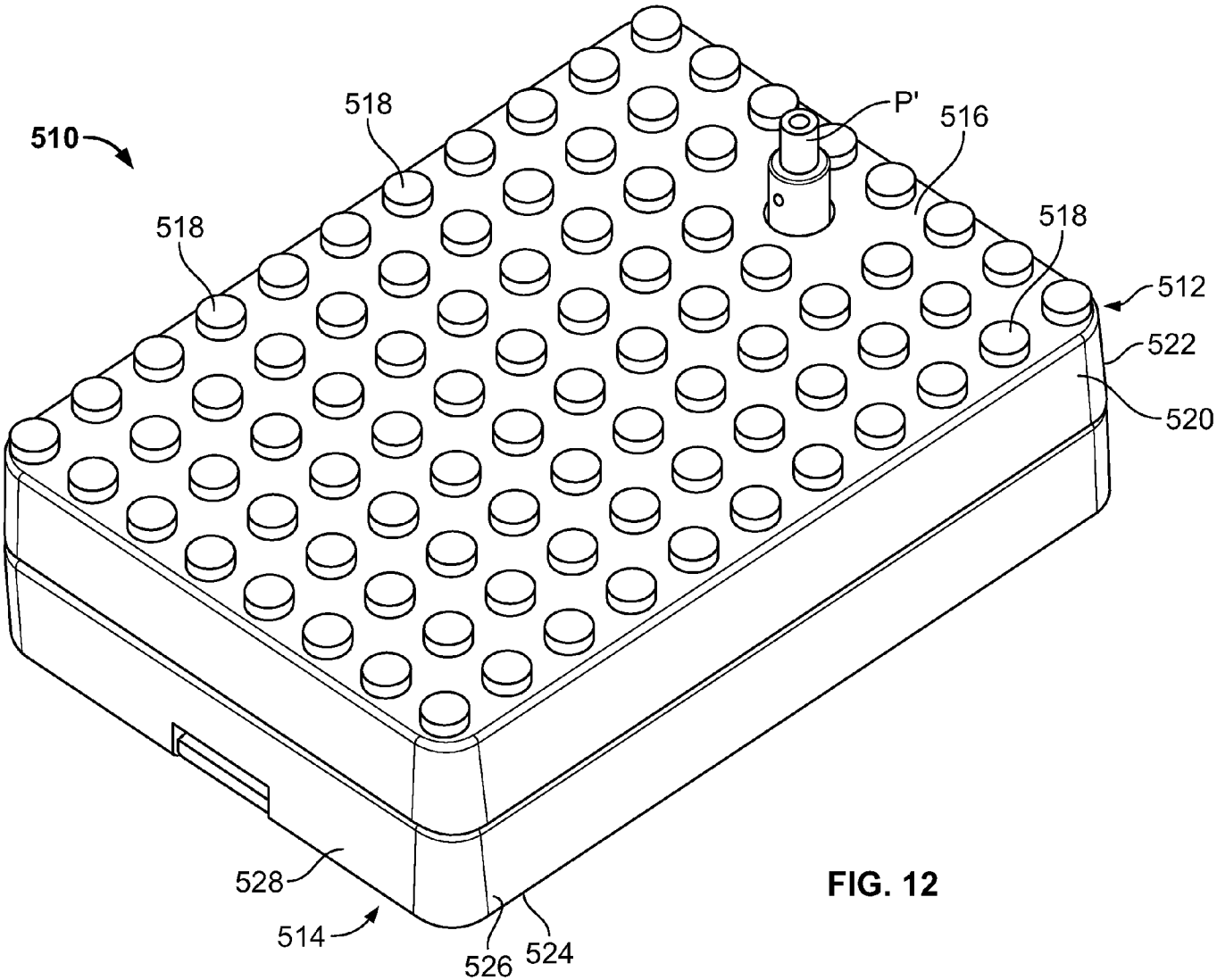
FIG. 12 is a top perspective view of a power supply module that may also function as a non-illumination module.

With reference to FIG. 12, a power supply module 510 has a top casing 512 that is releasably connected to a bottom casing 514. The top casing 512 has a top surface 516 with a series of projections 518 formed thereon that are sized and shaped so that the power supply module 510 can be releasably connected to one or more of the illumination modules 412 or to a compatible non-illumination module, such as LEGO® brick elements. The top casing 512 also has side surfaces 520 and end surfaces 522, each of which is void of projections like the projections 518. The bottom casing 514 has a bottom surface 524 with a series of projections (not shown) that are like the to projections 518 on the top casing 512, whereby the power supply module 510 can be releasably connected to additional illumination modules 412 or to other compatible non-illumination modules, such as LEGO® brick elements. The bottom casing 514 also has side surfaces 526 and end surfaces 528, each of which is void of projections like the projections 518.

The power supply module 510 has one or more batteries mounted therein (not shown) which are electrically connected to a plug P' by wires (not shown). An ON/OFF switch (not shown), which may be positioned on the bottom surface 524, is installed in the wiring connecting the batteries to the plug P' in order to electrically connect/disconnect the batteries to/from the plug P'. The plug P' is sized and shaped, and is mechanically and electrically constructed, in the same manner as the plug P of FIG. 1. Therefore, the plug P' is mechanically and electrically connectable to the jacks 16 and 116 of FIGS. 1 and 4, respectively. It is, understood, therefore, that since the plugs P', P are mechanically and electrically connectable to the jacks 16 and 116, the plugs P' and P can not be connectable in any manner (e.g., mechanically or electrically) to the couplers 14 and 114 of FIGS. 1 and 4, respectively. In other words, the plugs P', P are compatible with the jacks 16 and 116, but they are not compatible with the couplers 14 and 114. Needless to say, the plugs P', P could be modified so that they are compatible with the jacks 216, 316, and 416, instead of the jacks 16 and 116, in which case they would be incompatible with the couplers 214, 314, and 414, as well as the couplers 14 and 114.

As disclosed above, the power supply module 510 may be releasably connected to one or more of the illumination modules 412 or to one or more compatible non-illumination modules, such as LEGO® brick elements, via the series of projections 518 formed on the power supply module 510. The power supply module 510 may also be connected to one or more illumination modules 12 and 112 via the mechanical and electrical interconnection between the jacks 16 and 116 and the plug P'; it being understood that there may be more than one plug P' and that one or more of the additional plugs could be connected to one or more of the illumination modules 212, 312, and/or 412. The plug P' could also be omitted and replaced with one of the is projections 518, in which case a tethered plug (see, for instance, FIG. 16) could be employed to connect the power supply module 510 to the illumination modules 12, 112, on the one hand, or to the illumination modules 212, 312, and 412, on the other hand. The power supply module 510 is therefore capable of supplying electric power to any of the illumination modules 12, 112, 212, and 312, and 412. In an embodiment, the power supply module 510 may be powered by the DC-output of an AC transformer that is positioned either internally or externally of the power supply module 510.

Figure 13:
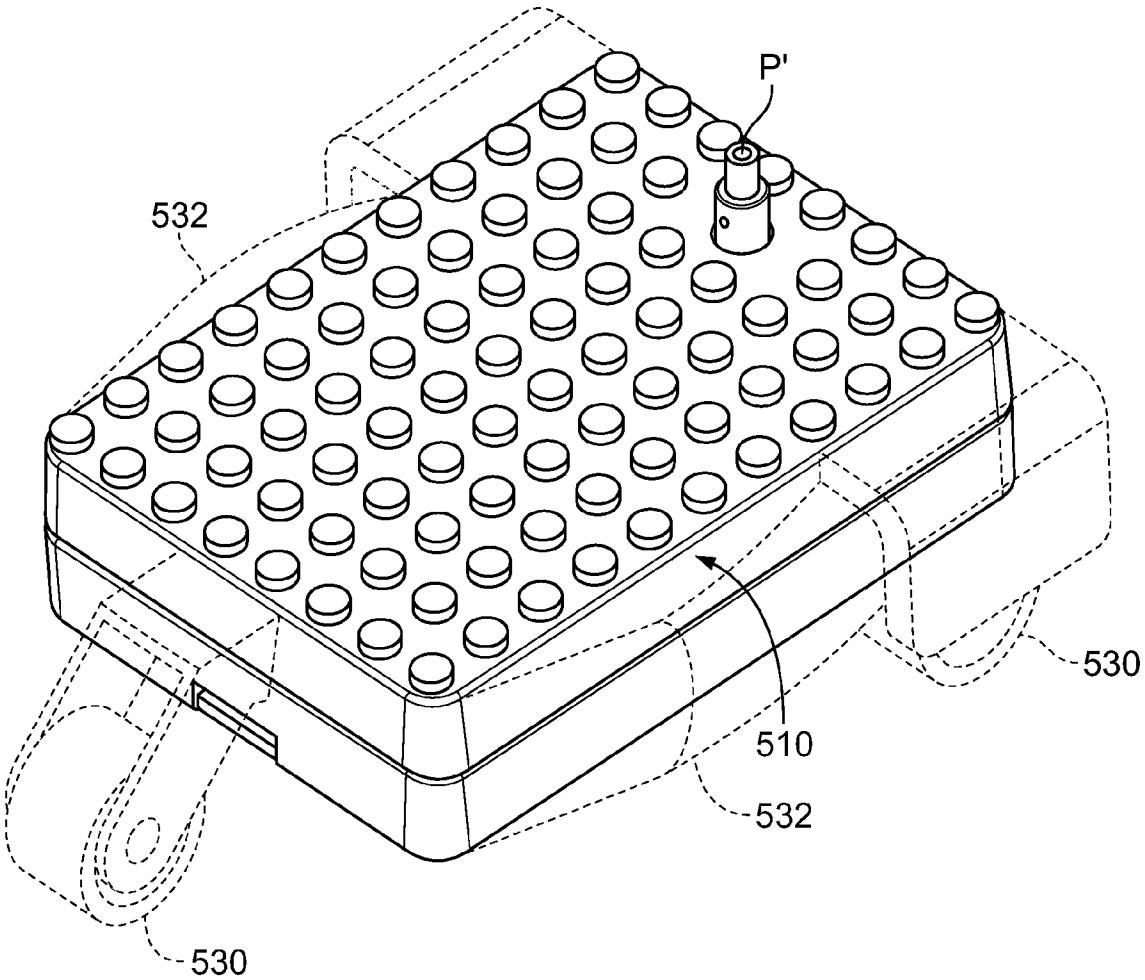
FIG. 13 is a top perspective view of the power supply module of FIG. 12 shown in combination with other components (illustrated in phantom) used to make a model of a jet fighter plane.
Figure 14:
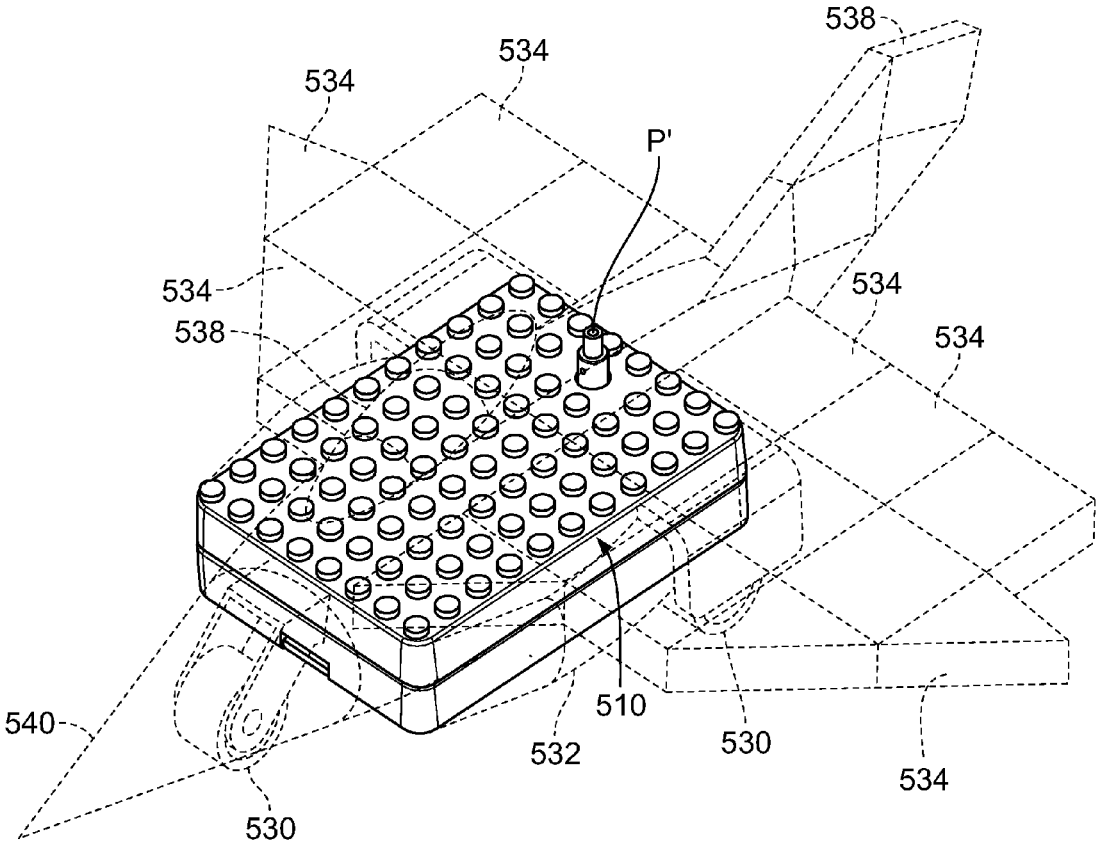
FIG. 14 is a top perspective view of the power supply module of FIG. 12 shown as part of a complete model of a jet fighter plane (illustrated in phantom)

As disclosed above, the power supply module 510 may also be releasably connected to one or more compatible non-illumination modules, such as LEGO® brick elements, via the series of projections 518 formed on the power supply module 510. For example, with reference to FIGS. 13 and 14, a model of a jet fighter plane is constructed around the power supply module 510, which therefore forms part of the model and functions as a non-illumination module therein. FIG. 13 shows non-illuminated decorative components such as wheels 530 and engine nacelles or housings 532 (depicted in phantom) fastened to the projections 518 of the power supply module 510. FIG. 14 shows additional decorative components fastened to the power supply module 510, such as wing elements 534, rudder elements 536, cockpit 538 and nose cone 540.

As disclosed above, the couplers 14, 114, 214, 314 and 414 of FIGS. 1, 4, 9A, 10B and 11A, respectively, may have various decorative designs and shapes. For example, referring to FIG. 15, a coupler 610 is shown in the form of a propeller. More particularly, the coupler 610 includes a propeller hub 612 having three blades 614. The coupler 610 also has a nose component 616, which extends outwardly from the front of the propeller hub 612, and a rear component 618, which extends outwardly from the rear of the hub 612. The nose and rear components 616, 618, respectively, are sized and shaped, and function in the same manner as, the opposed male-like (i.e., plug) ends 47*a*, 47*b* of the coupler 14 shown in FIGS. 1, 2A, 2C, 2D and 3. As a result, the coupler 610 may be mounted in one or more of the jacks 16, 116, 216, 316, and 416 of the illumination modules 12, 112, 212, and 312, and 412, respectively, via the nose and rear components 616, 618, respectively. Since the coupler 610 does not have a light source, it functions as a non-illumination module, just as the couplers 14, 114, 214, 314 and 414 may function as non-illumination modules.

Figure 16:
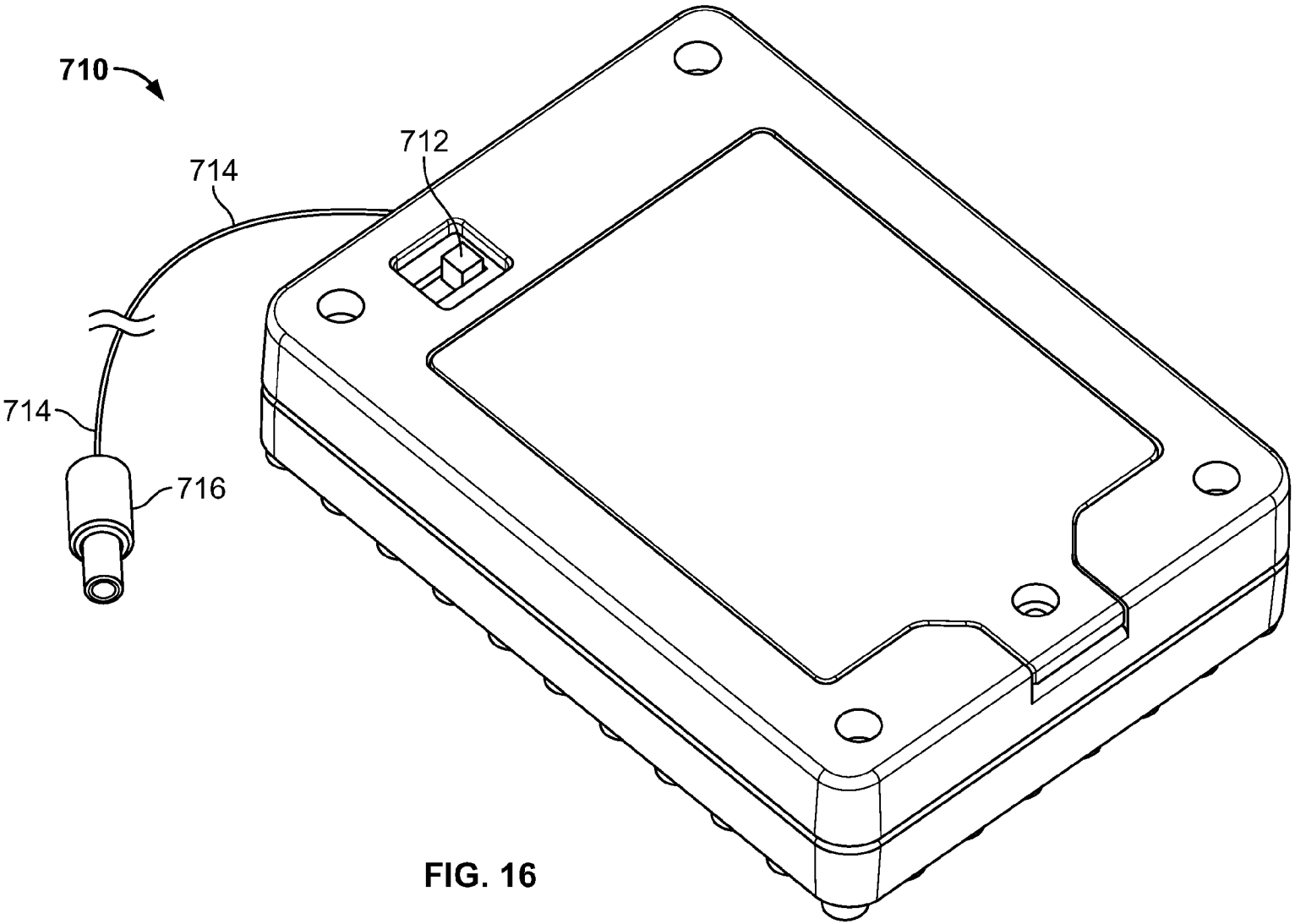
FIG. 16 is a bottom perspective view of an alternate power supply.

Referring to FIG. 16, a power supply 710 has, on its bottom or back surface, an ON/OFF switch 712 which controls a direct current power source such as: i) batteries (not shown) that are releasably mounted internally of the power supply 710; or ii) the direct current output of an alternating current transformer that is positioned externally of the power supply 710. The top or front surface (not shown) of the power supply 710 is provided with (i) projections like the projections 518 or (ii) a series of circular rings that would function in a manner similar to the projections 518. A power cord 714 extends from the power supply 710 to a power plug 716, which is sized and shaped, and is mechanically and electrically constructed, in the same manner as the couplers 214, 314 and 414 of FIGS. 9A, 10A and 11B, respectively. As a result, the plug 716 is mechanically and electrically connectable to the jacks 216, 316, and 416 of FIGS. 9A, 10A, and 11B, respectively. It is understood, therefore, that since the plug 716 is mechanically and electrically connectable to the jacks 216, 316, and 416, the plug 716 to can not be connected in any manner (e.g., mechanically or electrically) to the couplers 214, 314, and 414, respectively. In other words, the plug 716 is compatible with the jacks 216, 316, and 416, but it is not compatible with the couplers 214, 314, and 414. Needless to say, the plug 716 could be modified so that it is compatible with the jacks 16 and 116, instead of the jacks 216, 316, and 416, in which case it would be is incompatible with the couplers 14 and 114, as well as the couplers 214, 314, and 414. Optionally, the power supply 710 may be provided with special effects circuitry offering a variety of functions, such as voice activationor some other form of remote control, disco lighting, strobe lights and/or sound generation, including music. Such special effects circuitry may be accessed via a Mini USB plug (not shown) located on an exterior surface of the power supply 710. Similar special effects features could, of course, be provided on the power supply module 510.

It should be appreciated that the present invention provides numerous advantages. For instance, the jacks 16 of the illumination modules 12 are identical in size and shape to one another, thereby facilitating ease of use in assembling and disassembling the illumination modules 12 of the kit 10. Utilizing identically-shaped jacks 16 also minimizes the overall number of parts required to produce the kit 10, as well as minimizing the cost to produce the kit 10. Furthermore, the kit 10 may feature the illumination modules 12 and the couplers 14 consisting of various sizes and shapes as described above. An individual is, thus, able to construct from these components a wide array of forms (e.g., cars, buildings, aircrafts, tanks, science-fiction devices, etc.) having fascinating shapes and aesthetic light-emitting characteristics. In addition, the illuminated toy construction kits 310 and 410 employ printed-circuit-board-less assemblies 369, 481, respectfully, which are useful if the production requirements of the kits 310, 410 do not require the use of printed circuit board assemblies, such as those employed in the illuminated toy construction kits 10, 110, and 210. Also, the upper and lower casings 418, 420 of the kit 410 facilitate interconnection with other toy construction elements, thereby further extending the array of novel illuminated toy assemblies that an individual may construct.

It will be understood that the embodiments described herein are merely exemplary and that a person skilled in the art may make many variations and modifications without departing from the spirit and scope of the invention. All such variations and modifications, in addition to those described above, are intended to be included within the scope of the invention, as defined in the appended claims.

We claim:

1. An illuminated structure made from a toy construction kit, said illuminated structure comprising a plurality of illumination modules, each of said illumination modules having a housing with an interior defined by a plurality of exterior surfaces, a light-emitting element mounted in said interior of said housing, a plurality of openings, each of said openings being provided in a corresponding one of said exterior surfaces of said housing and communicating with said interior thereof, a plurality of jack-like members positioned in said interior of said housing, each jack-like member being electrically connected to said light-emitting element and having a receiving end recessed within said housing and aligned with a corresponding one of said openings; a plurality of non-illumination modules attached to said illumination modules, at least one of said non-illumination modules being a coupler element interconnecting one of said illumination modules with another of said illumination modules, said coupler element having a first plug-like end extending into said housing of said one illumination module through one of said openings therein and rotatably and releasably engaging said receiving end of one of said jack-like members of said one illumination module, said one jack-like member of said one illumination module being aligned with said one opening of said one illumination module to define a first axis about which said one illumination module is rotatable, in a clockwise direction and in a counterclockwise direction, relative to said coupler element and relative to said another illumination module, said first plug-like end of said coupler element being disengageable from said receiving end of said one jack-like member of said one illumination module in response to the axial movement of said one illumination module along said first axis regardless of the rotational position of said one illumination module relative to said coupler element, and a second plug-like end extending into said housing of said another illumination module through one of said openings therein and rotatably and releasably engaging said receiving end of one of said jack-like members of said another illumination module, said one jack-like member of said another illumination module being aligned with said one opening of said another illumination module to define a second axis about which said another illumination module is rotatable, in a clockwise direction and in a counterclockwise direction, relative to said coupler element and relative to said one illumination module, said second plug-like end of said coupler element being disengageable from said receiving end of said one jack-like member of said another illumination module in response to the axial movement of said another illumination module along said second axis regardless of the rotational position of said another illumination module relative to said coupler element, said coupler element electrically connecting said one jack-like member of said one illumination module to said one jack-like member of said another illumination module; and an electric power source in direct electric contact with another of said jack-like members of said one illumination module to thereby illuminate said light-emitting element of said one illumination module and said light-emitting element of said another illumination module.

2. An illuminated structure according to claim 1, wherein said light-emitting element of said one illumination module has a first electric contact and a second electric contact; and wherein each jack-like member of said one illumination module has a first electric conductor, which is electrically connected to said first electric contact of said light-emitting element of said one illumination module by a first electric conducting pathway, and a second electric conductor, which is electrically connected to said second electric contact of said light-emitting element of said one illumination module by a second electric conducting pathway.

3. An illuminated structure according to claim 2, wherein said light-emitting element of said another illumination module has a first electric contact and a second electric contact; and wherein each jack-like member of said another illumination module has a first electric conductor, which is electrically connected to said first electric contact of said light-emitting element of said another illumination module by a third electric conducting pathway, and a second electric conductor, which is electrically connected to said second electric contact of said light-emitting element of said another illumination module by a fourth electric conducting pathway.

4. An illuminated structure according to claim 3, wherein said coupler element has an inner sleeve, which is made from electric conducting material and, which is electrically connected to said first electric conductor of said one jack-like member of said one illumination module and to said first electric conductor of said one jack-like member of said another illumination module, and an outer sleeve, which is made from electric conducting material and which is electrically connected to said second electric conductor of said one jack-like member of said one illumination module and to said second electric conductor of said one jack-like member of said another illumination module, said outer sleeve being electrically insulated from said inner sleeve.

5. An illuminated structure according to claim 4, wherein said housing of said one illumination module includes first mounting means for mounting said light-emitting element of said one illumination module within said housing thereof; and wherein said housing of said another illumination module includes second mounting means for mounting said light-emitting element of said another illumination module within said housing thereof.

6. An illuminated structure according to claim 5, wherein each of said first and second mounting means includes an electric insulator interposed between a pair of electric conducting plates, one of said plates of said first mounting means forming at least a portion of said first electric conducting pathway, while the other of said plates of said first mounting means forms at least a portion of said second electric conducting pathway, and one of said plates of said second mounting means forming at least a portion of said third electric conducting pathway, while the other of said plates of said second mounting means forms at least a portion of said fourth electric conducting pathway.

7. An illuminated structure according to claim 6, wherein said first electric conductor of said one jack-like member of said one illumination module includes a first pin-like element, which is mechanically and electrically connected to said one plate of said first mounting means, said first pin-like element being releasably received within said first plug-like end of said coupler element so as to be electrically connected to said inner sleeve of said coupler element, and wherein said second electric conductor of said one jack-like member of said one illumination module includes a first spring-like clip, which is mechanically and electrically connected to said other plate of said first mounting means, said first spring-like clip being positioned about and resiliently engaging said first plug-like end of said coupler element so as to be electrically connected to said outer sleeve of said coupler element.

8. An illuminated structure according to claim 7, wherein said first electric conductor of said one jack-like member of said another illumination module includes a second pin-like element, which is mechanically and electrically connected to said one plate of said second mounting means, said second pin-like element being releasably received within said second plug-like end of said coupler element so as to be electrically connected to said inner sleeve of said coupler element, and wherein said second electric conductor of said one jack-like member of said another illumination module includes a second spring-like clip, which is mechanically and electrically connected to said other plate of said second mounting means, said second spring-like clip being positioned about and resiliently engaging said second plug-like end of said coupler element so as to be electrically connected to said outer sleeve of said coupler element.

9. An illuminated structure according to claim 8, wherein said housing of each of said illumination modules is made from a material that is an electric insulator, at least some of said exterior surfaces of said housing being transparent such that said interior of said housing is visible through said at least some of said exterior surfaces.

10. An illuminated structure according to claim 9, wherein said coupler element includes a collar-like member that is snugly, but removably, received within said one opening of said one illumination module and said one opening of said another illumination module to thereby stabilize said illuminated structure.

11. An illuminated structure according to claim 10, wherein said first and second plug-like ends of said coupler element are oriented coaxially relative to each other, whereby said first and second axes are coaxial.

12. An illuminated structure according to claim 10, wherein said first and second pluq-like ends of said coupler element are oriented obliquely relative to each other, whereby said first and second axes are not coaxial.

13. An illuminated structure according to claim 10, wherein said coupler element has a length selected so that said one illumination module is positioned in proximal to said another illumination module whereby said one illumination module and said another illumination module are proximal to each other.

14. An illuminated structure according to claim 10, wherein said coupler element has a length selected so that said one illumination module is positioned remote from said another illumination module.

15. An illuminated structure according to claim 14, wherein said collar-like member extends radially outward from said coupler element, said collar-like member having an outer peripheral surface that is engageable with a portion of said housing of said one illumination module that surrounds said one opening of said one illumination module and with a portion of said housing of said another illumination module that surrounds said one opening of said another illumination module.

16. An illuminated structure according to claim 15, wherein at least one of said exterior surfaces of said one illumination module includes mating means for mating with a complementary mating means on a compatible module, said mating means of said one illumination module including a plurality of spaced-apart projections arranged on said at least one exterior surface of said one illumination module.

17. An illuminated structure according to claim 16, wherein said compatible module is one of said plurality of non-illumination modules.

18. An illuminated structure according to claim 17, wherein said complementary mating means includes a plurality of spaced-apart projections arranged on a surface of said compatible module and a plurality of receptacles formed between said plurality of spaced-apart projections on said surface of said compatible module, each of said receptacles on said surface of said compatible module releasably receiving a selected one of said plurality of projections of said one illumination module.

19. An illuminated structure according to claim 13, wherein said exterior surfaces of said housing of said one illumination module include a plurality of side surfaces and a pair of opposed faces, each of said openings in said housing of said one illumination module being centrally located in a corresponding one of said side surfaces of said one illumination module, and said mating means of said one illumination module being provided on one of said opposed faces of said one illumination module.

20. An illuminated structure according to claim 1, wherein said plurality of illumination modules includes at least one other illumination module; and wherein said plurality of non-illumination modules includes another coupler element interconnecting said one illumination module with said one other illumination module, said another coupler element having a first plug-like end extending into said housing of said one illumination module through another of said openings therein and rotatably and releasably engaging said receiving end of one other of said jack-like members of said one illumination module, said one other of said jack-like members of said one illumination module being aligned with said another opening of said one illumination module to define a third axis which is arranged at an angle relative to said first axis and about which said one illumination module is rotatable, in a clockwise direction and in a counterclockwise direction, relative to said another coupler element and relative to said one other illumination module, said first plug-like end of said another coupler element being disengageable from said receiving end of said one other jack-like member of said one illumination module in response to the axial movement of said one illumination module along said third axis regardless of the rotational position of said one illumination module relative to said another coupler element, and a second plug-like end extending into said housing of said one other illumination module through one of said openings therein and rotatably and releasably engaging said receiving end of one of said jack-like members of said one other illumination module, said one jack-like member of said one other illumination module being aligned with said one opening of said one other illumination module to define a fourth axis about which said one other illumination is rotatable, in a clockwise direction and in a counterclockwise direction, relative to said another coupler element and relative to said one illumination module, said second plug-like end of said another coupler element being disengageable from said receiving end of said one jack-like member of said one other illumination module in response to the axial movement of said one other illumination module along said fourth axis regardless of the rotational position of said one other illumination module relative to said another coupler element, said another coupler element electrically connecting said one other jack-like member of said one illumination module to said one jack-like member of said one other illumination module to thereby illuminate said light-emitting element of said one other illumination module, and said another coupler element having sufficient flexibility such that it is bendable into a number of different positions.

* * * * *